US011844470B1

(12) United States Patent
Huang

(10) Patent No.: US 11,844,470 B1
(45) Date of Patent: Dec. 19, 2023

(54) HAND DRYING APPARATUS WITH MOISTURE ABSORPTION ARRANGEMENT

(71) Applicant: Wei Huang, Irvine, CA (US)

(72) Inventor: Wei Huang, Irvine, CA (US)

( * ) Notice: Subject to any disclaimer, the term of this patent is extended or adjusted under 35 U.S.C. 154(b) by 0 days.

(21) Appl. No.: 18/252,525

(22) PCT Filed: Dec. 13, 2022

(86) PCT No.: PCT/US2022/081402

§ 371 (c)(1),
(2) Date: May 10, 2023

(51) Int. Cl.
*A47K 10/28* (2006.01)

(52) U.S. Cl.
CPC ..... *A47K 10/28* (2013.01)

(58) Field of Classification Search
CPC ..... A47K 10/28
USPC ..... 34/95.1
See application file for complete search history.

(56) References Cited

U.S. PATENT DOCUMENTS

| | | | | |
|---|---|---|---|---|
| 2,322,552 | A * | 6/1943 | Sweetland | A47K 10/32 118/42 |
| 3,652,174 | A * | 3/1972 | Boone | B65D 83/384 118/325 |
| 7,774,953 | B1 * | 8/2010 | Duran | A47K 10/48 34/103 |
| 7,814,595 | B2 * | 10/2010 | Kafzan | A47K 10/30 312/34.15 |
| 7,856,840 | B2 * | 12/2010 | Yoon | F24F 3/1423 62/291 |
| 8,490,291 | B2 * | 7/2013 | Churchill | A47K 10/48 4/263 |
| 8,607,472 | B2 * | 12/2013 | Ishii | A61L 9/22 34/526 |
| 8,813,383 | B2 * | 8/2014 | Liu | A47K 10/48 15/97.1 |
| 9,524,604 | B2 * | 12/2016 | Erb | G07F 9/026 |
| 10,786,124 | B2 * | 9/2020 | Fujimura | A47K 10/48 |
| 11,103,111 | B1 | 8/2021 | Huang | |
| 2009/0032636 | A1 * | 2/2009 | Orlandi | A47K 10/32 242/560.1 |
| 2013/0055588 | A1 | 3/2013 | Nakamura et al. | |
| 2023/0248188 | A1 * | 8/2023 | Huang | A47K 10/28 312/34.9 |

FOREIGN PATENT DOCUMENTS

| | | | |
|---|---|---|---|
| CN | 105640412 | A | 6/2016 |
| FR | 1420596 | A * | 11/1965 |

* cited by examiner

*Primary Examiner* — Stephen M Gravini
(74) *Attorney, Agent, or Firm* — Tsz Lung Yeung

(57) ABSTRACT

A hand drying apparatus includes an outer case and a moisture absorption arrangement. The moisture absorption arrangement includes a first supporting member, a second supporting member, a plurality of moisture absorption enhancers, an actuating mechanism connected to the moisture absorption enhancers, at least one driving rotor, and a plurality of fabric supporters. The hand drying apparatus is capable of operating between an idle mode and a drying mode, wherein in the idle mode, the first supporting member and the second supporting member are positioned and retained to space apart from each other, wherein in the drying mode, the first supporting member is driven to move toward the second supporting member for allowing the fabric sheet to contact with the user's hand. At the same time, the actuating mechanism drives the moisture absorption enhancers to move for absorbing moisture from said user's hands and finger crevices.

23 Claims, 9 Drawing Sheets

HAND DRYING APPARATUS WITH MOISTURE ABSORPTION ARRANGEMENT

BACKGROUND OF THE PRESENT INVENTION

Field of Invention

The present invention relates to a hand drying apparatus, and more particularly to a hand drying apparatus comprising a moisture absorption arrangement which is capable of exerting pressure to and absorbing moisture from a user's hand for drying thereof by a fabric sheet, such as a towel.

Description of Related Arts

Conventionally, there exist several kinds of hand drying apparatuses which are used for drying a user's hand. For example, some conventional drying apparatuses utilizes heated air for drying a user's hand. The disadvantages of this kind of hand drying apparatuses are that they need a considerable amount of power to operate. The electrical and mechanical components which are used to rapidly heat ambient air and blow the heated air to the user's hand consume a substantial amount of energy. Despite this, users' hands are not often dry enough to allow satisfactory users' experience.

Another kind of hand drying apparatus is disposable paper towel dispensers. An obvious disadvantage of this type of hand drying apparatuses is that they are not environmentally friendly. Paper towel dispensers consume a large amount of paper towels. A lot of paper towels are dispensed unnecessarily because users tend to require a new paper towel before the an existing one are thoroughly utilized. This produces a substantial amount of waste.

Another kind of hand drying apparatus is fabric towel dispensers. This type of hand drying apparatuses is different from the disposable paper towel dispensers mentioned above because it dispenses reusable fabric towels for users to dry their hands. A major disadvantage is that a user has to manually squeeze the fabric towel to allow effective absorption of water from the user's hand. When the fabric towels are used for an extended period of time, the fabric towels may deform and become hard to fit in the fabric towel dispensers for reuse. Used fabric towels may also be easily stuck in other components of the apparatus. Moreover, conventional hand drying apparatuses are not truly automatic because the users have to manually squeeze the dispensed fabric towel.

U.S. Pat. No. 11,103,111 ('111 patent) to Huang generally disclose a hand drying apparatus comprising a dispensing and squeezing arrangement which comprises at least a first support panel and a second support panel provided in an outer case, wherein the second support panel is provided in the outer case at a position spaced apart from the first support panel to form at least one drying cavity as a space formed between the first support panel and the second support panel for accommodating the user's hand.

The major disadvantage in associated with the hand drying apparatus disclosed in '111 patent is that there is virtually no rubbing movement between each of the supporting panels and the user's hand. As a result, the time of absorbing moisture from the users' hand is prolonged. Moreover, moisture trapped in user's fingers may not be satisfactorily absorbed by the relative movement between the first supporting panel and the second supporting panel alone.

As a result, there is a need to develop a hand drying apparatus which provide enhanced hand drying performance and more ergonomically sound with respect to a human hand.

SUMMARY OF THE PRESENT INVENTION

Certain variations of the present invention provide a hand drying apparatus comprising moisture absorption arrangement which is capable of exerting pressure to and absorbing moisture from a user's hand for drying thereof by a fabric sheet, such as a towel.

Certain variations of the present invention provide a hand drying apparatus comprising a moisture absorption arrangement which may allow paper towel or fabric towel to tightly press against a user's hand for absorbing moisture thereof.

Certain variations of the present invention provide a hand drying apparatus comprising a moisture absorption arrangement in which a plurality of moisture absorption enhancers is capable of generating a rubbing or vibrational motion for better absorbing moisture from the user's hand.

In one aspect of the present invention, it provides a hand drying apparatus for a fabric sheet used for absorbing moisture from a user's hand, the hand drying apparatus comprising:

an outer case; and a moisture absorption arrangement, which comprises:

a first supporting member and a second supporting member provided in said outer case, said second supporting member being provided in said outer case at a position spaced apart from said first supporting member to form at least one drying cavity as a space formed between said first supporting member and said second supporting member for accommodating said user's hand;

a plurality of moisture absorption enhancers supported on said first supporting member and extend in said drying cavity;

a driving mechanism supported in the outer case and connected to one of the first supporting member and the second supporting member for driving at least the first supporting member to move with respect to the second supporting member;

an actuating mechanism supported in said outer case to operatively drive said moisture absorption enhancers;

at least one driving rotor rotatably supported in said outer case for driving said fabric sheet to move in a predetermined direction;

a plurality of fabric supporters provided in said outer case and positioned to support said fabric sheet between said first supporting member and said second supporting member in a slidably movable manner;

said hand drying apparatus being operated between an idle mode and a drying mode, wherein in said idle mode, said first supporting member and said second supporting member are positioned and retained to space apart from each other, wherein in said drying mode, said first supporting member is driven to move toward said second supporting member by the driving mechanism for allowing said fabric sheet supported on said first supporting member and said second supporting member to contact with said user's hand in said drying cavity, said actuating mechanism driving said moisture absorption enhancers to absorb moisture from said user's hand.

This summary presented above is provided merely to introduce certain concepts and not to identify any key or essential features of the claimed subject matter.

DETAILED DESCRIPTION OF THE PREFERRED EMBODIMENT

Figure 1:
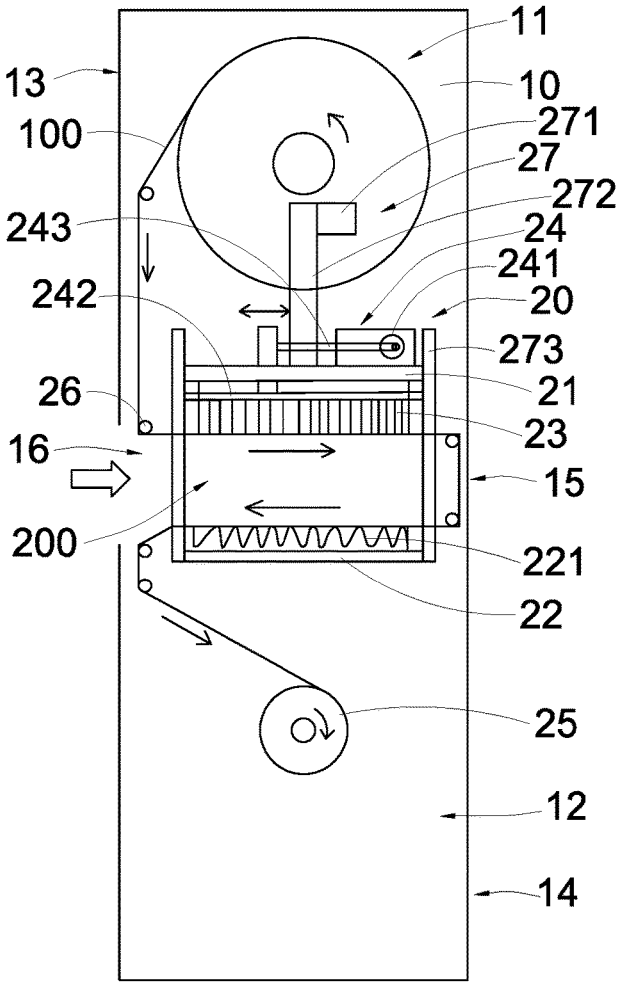
FIG. 1 is a side view of a hand drying apparatus according to a first preferred embodiment of the present invention.

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Referring to FIG. 1 to FIG. 4 of the drawings, a hand drying apparatus according to a first preferred embodiment of the present invention is illustrated. Broadly, the hand drying apparatus may comprise an outer case 10 and a moisture absorption arrangement 20. The hand drying apparatus may be configured for a fabric sheet 100 used for absorbing moisture from a user's hand. The fabric sheet 100 may be a sheet of paper towel or a sheet of fabric towel.

The moisture absorption arrangement 20 may comprise a first supporting member 21, a second supporting member 22, a plurality of moisture absorption enhancers 23, an actuating mechanism 24, at least one driving rotor 25, a plurality of fabric supporters 26, and a driving mechanism 27.

The first supporting member 21 and a second supporting member 22 may be provided in the outer case 10. The second supporting member 22 may be provided in the outer case 10 at a position spaced apart from the first supporting member 21 to form at least one drying cavity 200 as a space formed between the first supporting member 21 and the second supporting member 22 for accommodating the user's hand.

The plurality of moisture absorption enhancers 23 may be supported on the first supporting member 21 and extend in the drying cavity 200.

The driving mechanism 27 may be supported in the outer case 10 and connected to at least one of the first supporting member 21 and the second supporting member 22 for driving at least the first supporting member 21 to move with respect to the second supporting member 22.

The actuating mechanism 24 may be supported in the outer case to operatively drive the moisture absorption enhancers 23.

The driving rotor 25 may be rotatably supported in the outer case 10 for driving the fabric sheet 100 to move in a predetermined direction in the outer case 10.

The plurality of fabric supporters 26 may be provided in the outer case 10 and positioned to support the fabric sheet 100 between the first supporting member 21 and the second supporting member 22 in a slidably movable manner.

The hand drying apparatus may be operated between an idle mode and a drying mode, wherein in the idle mode, the first supporting member 21 and the second supporting member 22 may be positioned and retained to space apart from each other, wherein in the drying mode, the first supporting member 21 is driven to move toward the second supporting member 22 by the driving mechanism 27 for allowing the fabric sheet 100 supported on the first supporting member 21 and the second supporting member 22 to contact with the user's hand in the drying cavity 200. The actuating mechanism 24 may then drive the moisture absorption enhancers 23 to absorb moisture from the user's hand through a portion of fabric sheet 100.

According to the first preferred embodiment of the present invention, the hand drying apparatus of the present invention may utilize the fabric sheet 100 as a medium for absorbing moisture from the user's hands. Preferably, the fabric sheet 100 may be configured as fabric towel. Alternatively, paper towel may also be used. The fabric sheet 100 may therefore need to possess a predetermined amount of water absorbing ability so that when the fabric sheet 100 is in contact with the users' hands, water on the users' hands may be absorbed by the fabric sheet 100. The fabric sheet 100 may be folded or rolled to be continuously supplied to the moisture absorption arrangement 20.

The outer case 10 may have a storage compartment 11 for storing cleaned, unused fabric sheet 100, and a collecting compartment 12 for storing used fabric sheet 100. The fabric sheet 100 may be guided to controllably move from the storage compartment 11 to the collecting compartment 12 through the moisture absorption arrangement 20. In this first preferred embodiment, the storage compartment 11 may be provided on an upper portion 13 of the outer case 10, while the collecting compartment 12 may be provided on a lower portion 14 of the outer case 10. The moisture absorption arrangement 20 may be provided between the storage compartment 11 and the collecting compartment 12 at a mid-portion 15 of the outer case 10. As described below, the positions of the storage compartment 11, the collecting compartment 12 and the moisture absorption arrangement 20 with respect to the outer case 10 may be varied according to the different circumstances in which the present invention is manufactured.

In this preferred embodiment, the fabric sheet 100 may be configured as a roll and may be supported in the storage compartment 11, possibly through a latch or a roller. A certain amount of the fabric sheet 100 may be pulled out from the roll and fed to the moisture absorption arrangement 20. As such, the moisture absorption arrangement 20 may have a continuous supply of fabric sheet 100.

The outer case 10 may further have an access opening 16 for allowing a user to access the drying cavity 200 through the access opening 16. Thus, the access opening 16 may be formed at a position corresponding to that of the drying cavity 200 so that a user may be able to put his or her hand in the drying cavity 200 through penetrating the access opening 16. Note that the number of drying cavities 200 and the access openings 16 may be varied according to an actual configuration of the present invention. Some of these configurations will be described below.

The driving rotor 25 may be distributed in the outer case 10 in a rotatably movable manner for driving the fabric sheet 100 to move in a predetermined path dictated by the spatial distribution of the driving rotor 25 and the fabric supporters 26. The objective is to guide the fabric sheet 100 to move from the storage compartment 11 and pass through the drying cavity 200 and to be finally in the collecting compartment 12. The driving rotor 25 may be arranged to support a portion of the fabric sheet 100 so that when the driving rotor 25 rotates, the fabric sheet 100 may be driven to move in the direction of rotation of the driving rotor 25. It is worth mentioning that the fabric sheet 100 may be supported on the driving rotor 25 and the fabric supporters 26 in a stretched manner so as to maintain a predetermined tension on the fabric sheet 100 when it travels along the driving rotor 25 and the fabric supporters 26. The moisture absorption arrangement 20 may comprise at least one driving rotor 25. In some variations, several driving rotors 25 may be provided to drive the fabric sheet 100.

Moreover, at least two of the fabric supporters 26 may be provided in outer case 10 in such a manner that a portion of unused fabric sheet 100 may extend above the first supporting member 21 and the second supporting member 22. It is important to point out that the exact number of driving rotor 25 and the fabric supporters 26 employed in the outer case 10 may depend on the exact configuration of the outer case 10, and the desirable travel path of the fabric sheet 100.

The fabric supporters 26 may be mounted in the outer case 10 for supporting the fabric sheet 100 in a tensioned manner. The fabric supporters 26 may be stationary or rotatably mounted in the outer case 10. The purpose of the fabric supporters 26 is to guide and support the fabric sheet 100 to travel in a predetermined direction as driven by the driving rotor 25. The exact number of the fabric supporters 26 may depend on the exact configuration of the outer case 10, and the desirable travel path of the fabric sheet 100. For example, as shown in FIG. 1 of the drawings, two fabric supporters 26 may be mounted near two ends of the first supporting member 21 respectively, while other two fabric supporters 26 may be mounted near two ends of the second supporting member 22 respectively, wherein the fabric sheet 100 may be guided to extend on the first supporting member 21 and the second supporting member 22 to form a U-shaped configuration of the fabric sheet 100 extending in the drying cavity 200 as viewed from the side.

Each of the fabric supporters 26 may be configured as an elongated rod or pin which may provide secure support to the fabric sheet 100 when it is driven to move by the driving rotor 25. Other shapes may also be possible.

The first supporting member 21 and the second supporting member 22 may be mounted in the outer case 10 for providing supports to the fabric sheet 100 and the user's hand. At least one of the first supporting member 21 and the second supporting member 22 may be movably mounted in the outer case 10. The movement of the first supporting member 21 and/or the second supporting member 22 may be actuated by the driving mechanism 27 described below. In the first preferred embodiment of the present invention, the second supporting member 22 may be securely and immovably provided in the outer case 10 while the first supporting member 21 may be movably mounted in the outer case 10 to move toward or away from the second supporting member 22. As shown in FIG. 1 of the drawings, the first supporting member 21 may be provided above the second supporting member 22.

It is also worth mentioning that the second supporting member 22 may be mounted or connected in the outer case 10 as a separate element. Alternatively, the second supporting member 22 may also be integrally formed on the outer case 10 so that the outer case 10 and the second supporting member 22 form an integral single component. From manufacturing perspective, the outer case 10 and the second supporting member 22 may be formed together as a whole without external connection or mounting.

In the first preferred embodiment of the present invention, the first supporting member 21 may be provided above the second supporting member 22 in such a manner that the first supporting member 21 may be moved towards or away from the second supporting member 22.

The second supporting member 22 may be configured as a panel for allowing a user's hand to rest thereon. This panel may be flat or may have predetermined contour. The first supporting member 21 may be arranged to support the moisture absorption enhancers 23 in an operatively movable manner. Thus, the first supporting member 21 may be configured as a panel or a supporting frame on which a mounting frame 242 or board are movably mounted. Also, the moisture absorption enhancers 23 are mounted on the downside of mounting frame 242. The moisture absorption enhancers 23 may extend downwardly from the first supporting member 21 to reach the drying cavity 200.

It is worth mentioning that, depending on the circumstances in which the present invention is manufactured or operated, the position of the first supporting member 21 and the second supporting member 22 may be interchanged.

The moisture absorption arrangement 20 may further comprise a driving mechanism 27 provided in the outer case 10 for driving at least one of the first supporting member 21 and the second supporting member 22 to move toward the other supporting member 21(22). In this first preferred embodiment, the first supporting member 21 may be positioned above the second supporting member 22 wherein the driving mechanism 27 may be configured to drive the first supporting member 21 to move toward or away from the second supporting member 22 so as to adjust the size and the volume of the driving cavity 200.

Figure 2:
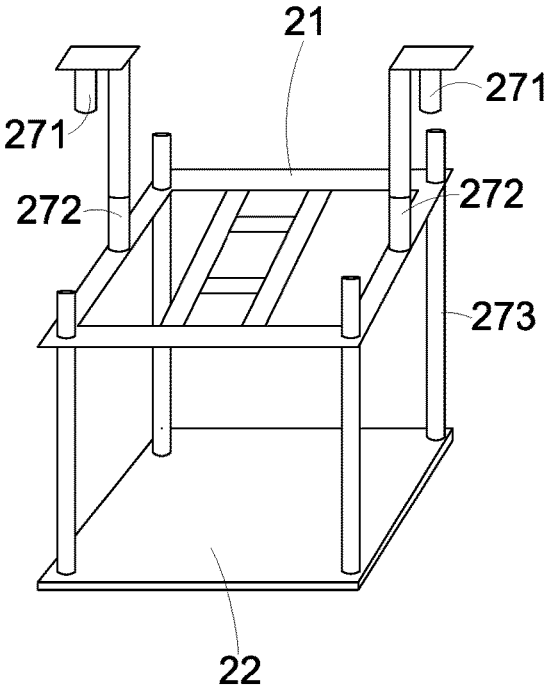
FIG. 2 is a schematic view of a first supporting frame of the hand drying apparatus according to the first preferred embodiment of the present invention.

As shown in FIG. 1 to FIG. 2 of the drawings, the driving mechanism 27 may comprise a driving motor 271 mounted in the outer case 10 and connect to the first supporting member 21, a driving pin 272 extended from the driving motor 271 to operatively engage with the first supporting member 21, and a plurality of guiding rods 273 extended between the first supporting member 21 and the second supporting member 22. When the driving motor 271 is actuated, the driving pin 272 may be driven to rotate. The rotation of the driving pin 272 may in turn drive the first supporting member 21 to move upwardly or downwardly along the driving pin 272. When the driving pin 272 is oriented to align with a longitudinal direction of the outer case 10, the first supporting member 21 may also be arranged to move along a longitudinal direction with respect to the outer case 10.

The guiding rods 273 may extend between the first supporting member 21 and the second supporting member 22. When the first supporting member 21 moves with respect to the second supporting member 22, the guiding rods 273 may guide the upward or downward movement of the first supporting member 21 so as to make the movement stable and accurate. In this preferred embodiment of the present invention, the driving mechanism 27 may have four guiding rods 273 which may be connected to four corner portions of the first supporting member 21 and the second supporting member 22 respectively.

According to the first preferred embodiment of the present invention, the second supporting panel 22 may remain stationary in the outer case 10.

The moisture absorption arrangement 20 may further comprise at least one deformable pad 221 supported on the second supporting member 22 for supporting the user's hand. When the user's hand rest on the second supporting member 22, the deformable pad 221 may slightly deform due to the hand's weight. Further deformation may occur when the first supporting member 21 and the moisture absorption enhancers 23 are driven to depress on the user's hand. This slight deformation may allow the fabric sheet 100 to deform slightly so as to better absorb moisture from the user's hand. The deformable pad 221 may be configured from soft or foam material such as memory foam, silicone pad, sponge foam, etc. The deformable pad 221 may be supported on an upper side of the second supporting member 22 while a portion of the fabric sheet 100 may be supported on the deformable pad 221.

The moisture absorption arrangement 20 may further comprise at least one electric motor 251 connected to the driving rotor 25 for driving the fabric sheet 100 to move along a path dictated by the distribution of the driving rotor 25. When the fabric sheet 100 is engaged with the driving rotor 25, the rotational movement of the driving rotor 25 may drive a particular portion of the fabric sheet 100 to move along the corresponding_fabric supporters 26.

The moisture absorption enhancers 23 may be configured as a plurality of brushes or a soft pad of a specific shape which may be made from soft and flexible material extending from the first supporting member 21. In order to drive the moisture absorption enhancers 23, the actuating mechanism 24 may comprise an actuating motor 241 mounted on the first supporting member 21, and a mounting frame 242 movably mounted on the first supporting member 21, wherein the moisture absorption enhancers 23 may be mounted on the mounting frame 242.

As shown in FIG. 1 of the drawings, the mounting frame 242 may be connected to a driving shaft 243 of the actuating motor 241. The actuating motor 241 may be configured as an eccentric or normal motor so that when the actuating motor 241 is actuated, the driving shaft 243 may also be driven to move in a reciprocating manner along a transverse direction of the mounting frame 242. When the driving shaft 243 is driven to move in the reciprocating manner with respect to the first supporting member 21, the mounting frame 242 and the moisture absorption enhancers 23 may also be driven to move in corresponding directions so as to facilitate back-and-forth brushing movement on the user's hand.

Figure 4:
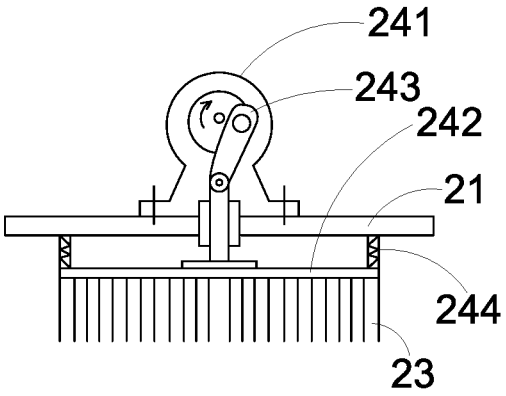
FIG. 4 is schematic view of an alternative configuration of an actuating motor of the hand drying apparatus according to the first preferred embodiment of the present invention.

As shown in FIG. 4 of the drawings, some other alternatives of the actuating motor 24 comprises an actuating motor 241 having a driving shaft 243, and a connection member 244 connecting the first supporting member 21 to the mounting frame 242, wherein the driving shaft 243 may be driven to move in a reciprocating manner along a vertical direction with respect to first supporting member 21. When the actuating motor 241 is driven to move, the mounting frame 242 and the moisture absorption enhancers 23 may also be driven to move in corresponding directions so as to facilitate corresponding reciprocating movement to facilitate up-and-down massage movement on the user's hand. The actuating motor 241 may be configured as an eccentric or normal motor. The connection member 244 may be configured as a guiding shaft or a compression spring.

Figure 3:
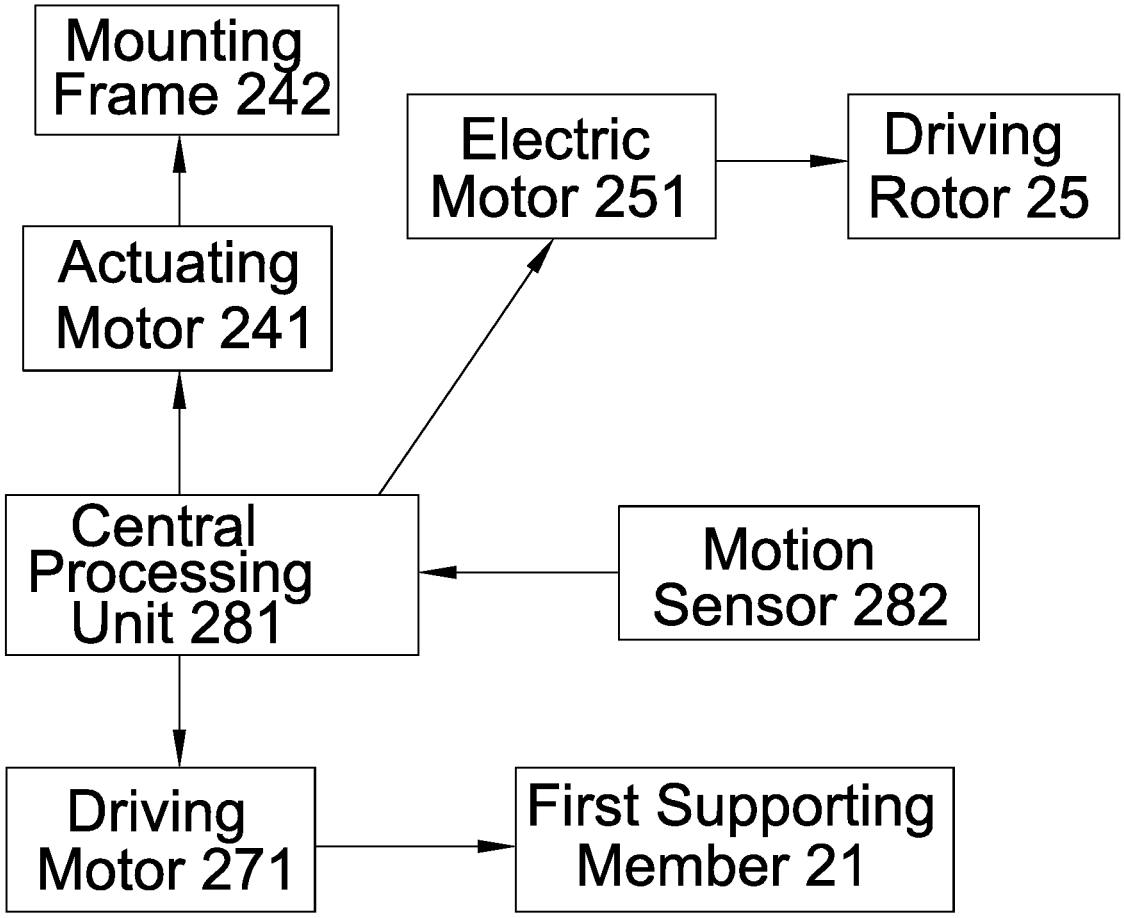
FIG. 3 is a block diagram illustrating the relationship between a driving rotor, an electric motor, an actuating motor, and a central processing unit of the hand drying apparatus according to the first preferred embodiment of the present invention.

As shown in FIG. 3 of the drawings, the moisture absorption arrangement 20 may further comprise a central processing unit 281 electrically connected to the electric motor 251 and the driving motor 271, and at least one motion sensor 282 provided in the drying cavity 200 and electrically connected to the central processing unit 281 for sensing a presence of motion in the drying cavity 200. The central processing unit 281 may be programmed to control the operation of the driving motor 271, the electric motor 251 and the actuating motor 241 when signals from the motion sensor 282 are received. When motion signal is received, the central processing unit 281 may drive the driving motor 271 to move the first supporting member 21 toward the second supporting member 22, and at the same time, to drive the fabric sheet 100 to move in the direction from the storage compartment 11 to the collecting compartment 12 via the electric motor 251. Furthermore, the central processing unit 281 may also drive the actuating motor 241 to start the reciprocal movement of the moisture absorption enhancers 23 when the first supporting member 21 has moved toward the second supporting member 22.

It is worth mentioning that used fabric sheet 100 may be moved to accommodate in the collecting compartment 12 which may be located underneath the moisture absorption arrangement 20. When all the fabric sheet 100 has been used, the used fabric sheet 100 may be taken out for cleaning so that it may be re-accommodated in the storage compartment 11 and reused for drying in the manner described above.

The operation of the present invention may be as follows: when no object is in the drying cavity 200, the hand drying apparatus is idle. When a user wants to dry his hand, he may put his hands into the drying cavity 200 through the access opening 16. When his hands are in the drying cavity 200 and rest his hands on the fabric sheet 100 disposed on the deformable pad 221 and the second supporting member 22, the motion sensor 282 may detect motion and send the corresponding signal to the central processing unit 281. The central processing unit 281 may then drive the corresponding driving motor 271 to rotate so as to actuate the driving mechanism 271. The first supporting member 21 may then be driven to move toward the second supporting member 22 until a predetermined distance between the first supporting member 21 and the second supporting member 22 is reached.

At this time, the central processing unit 281 may actuate the actuating motor 241 so as to drive the mounting frame 243 and the moisture absorption enhancers 23 to move on the user's hand in a reciprocating manner. As mentioned above, the reciprocating movement of the moisture absorption enhancers 23 may create a brushing or massage effect to the user's hand. As such, the user's hand may be dried by "dual actions", in which the first action being a squeezing action between the first supporting member 21 and the second supporting member 22, while the second action being the brushing action effectuated by the moisture absorption enhancers 23. In these dual actions, the fabric sheet 100 supported on the first supporting member 21 may come into contact with the gap between user's fingers. The pressure exerted by the first supporting member 21 may slightly depress the user's hand and squeeze the deformable pads 221 so as to allow the user's hands to be surrounded or wrapped by the fabric sheet 100. The moisture absorption effect may then be enhanced by the brushing movement of the moisture absorption enhancers 23.

The first supporting member 21 may be configured to depress on the user's hand for a predetermined period of time. When the first supporting member 21 reaches a predetermined distance from the second supporting member 22, the actuating mechanism 24 may be actuated to perform the brushing action on the user's hand. After the actuating mechanism 24 has been actuated for a predetermined amount of time, the actuating mechanism 24 may be deactivated and the first supporting member 21 may be driven to move away from the second supporting member 22. At this time, the user may move his hands out of the drying cavity 200 through the access opening 16. The electric motor 251 may then be actuated to drive the fabric sheet 100 to move forward toward the direction of collecting compartment 12 so as to replace used fabric sheet 100 in the drying cavity 200 with unused fabric sheet 100.

Figure 5:
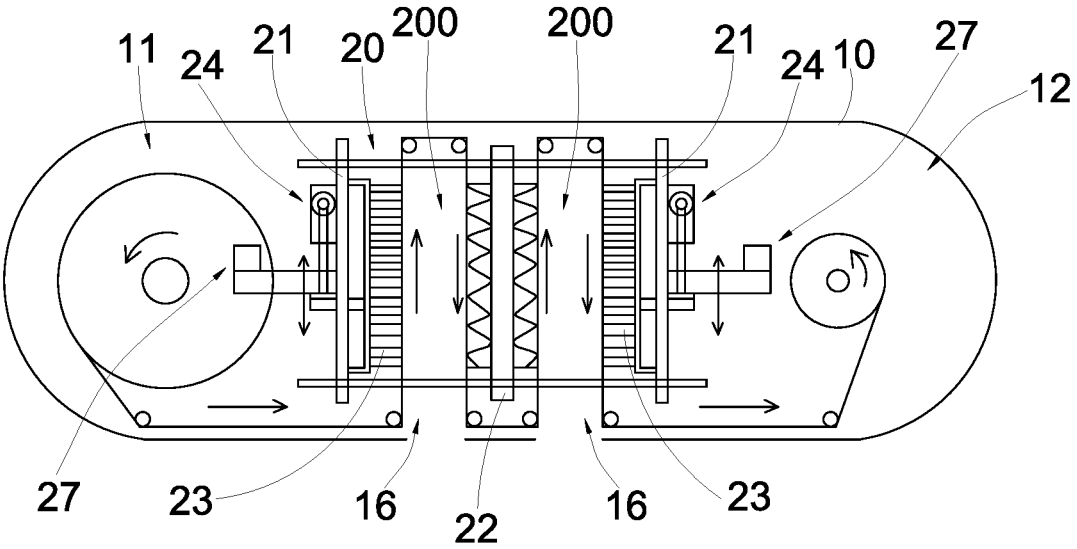
FIG. 5 is a plan view of a first alternative mode of the hand drying apparatus according to the first preferred embodiment of the present invention.

It is worth mentioning that the arrangement of the various components of the hand drying apparatus as described above may have several alternatives and variations. Some of these alternatives and variations may be described below. For example, FIG. 5 illustrates a first alternative mode of the hand drying apparatus of the present invention in which the storage compartment 11, the collecting compartment 12 and the moisture absorption arrangement 20 may be arranged and configured in a side-by-side manner (as opposed to up-and-down manner) so that fabric sheet 100 may travel from the storage compartment 11 sidewardly to the moisture absorption arrangement 20 and eventually to the collecting compartment 12.

Moreover, the hand drying apparatus may comprise two drying cavities 200 and two access openings 16 arranged in a side-by-side manner. As shown in FIG. 5 of the drawings, the drying cavities 200 and the access openings 16 may be shaped and sized to form a vertical orientation. The orientation of the drying cavities 200 and the access openings 161 may determine the orientation in which the user's hands are disposed in the drying cavities 200. The configuration of the other components may also be adjusted accordingly.

In this first alternative mode, some components of the moisture absorption arrangement 20 described above may be doubled so as that each of the drying cavities 200 may be served by one more first supporting member 21, one more deformable pad 23, one more actuating mechanism 24 and one more driving mechanism 27 described above. Fabric sheet 100 may be arranged to travel from the storage compartment 11, two drying cavities 200 and eventually reach the collecting compartment 12. The moisture absorption arrangement 20 may comprise a single second supporting member 22 in which the two first supporting members 21 may move towards or away from the second supporting member 22. The deformable pads 221 may be provided on two sides of the second supporting member 22 respectively.

Figure 6:
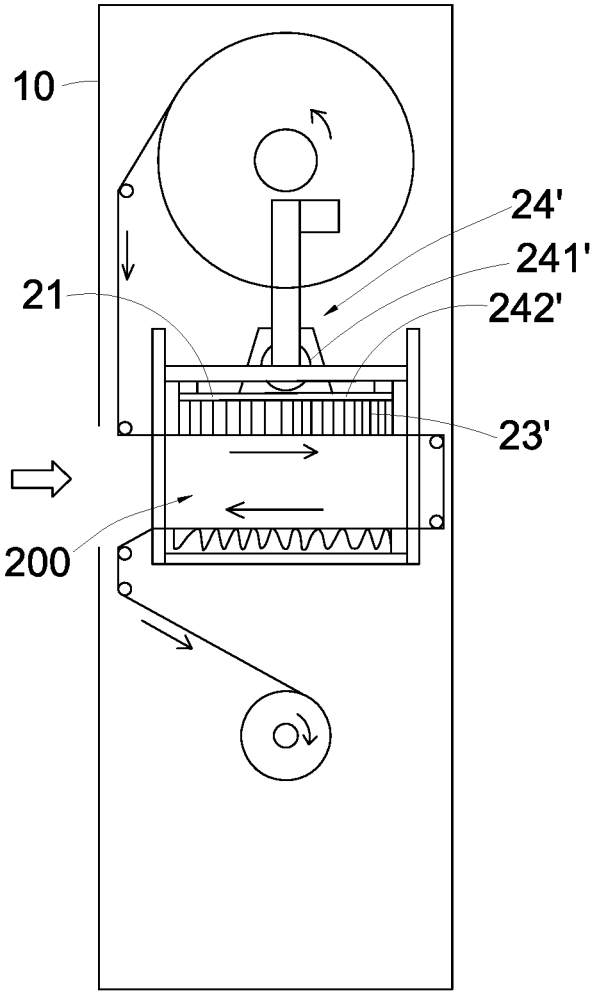
FIG. 6 is a side view of a hand drying apparatus according to a second alternative mode of the first preferred embodiment of the present invention.
Figure 7:
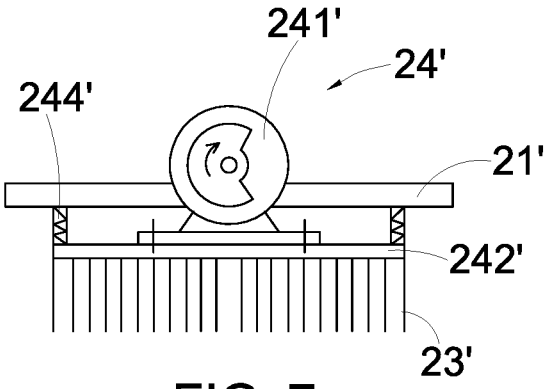
FIG. 7 is a schematic diagram of an actuating mechanism of the hand drying apparatus according to a second alternative mode of the first preferred embodiment of the present invention.

Referring to FIG. 6 to FIG. 7 of the drawings, a second alternative mode of the hand drying apparatus according to the first preferred embodiment of the present invention is illustrated. The second alternative mode is identical to the first preferred embodiment described above, except the actuating mechanism 24'. According to the second alternative mode, the actuating mechanism 24' may be arranged to impart a vibration-like effect (instead of brushing or massage effect as described above) to the user's hand so as to enhance moisture absorption from the user's hand through vibration movement of the moisture absorption enhancers 23.

Specifically, the actuating mechanism 24' in the second alternative mode may comprise an actuating motor 241' connected to the mounting frame 242' supported by the first supporting member 21', wherein the moisture absorption enhancers 23' may extend from the mounting frame 242' to reach the drying cavity 200. The actuating motor 241' may be configured as an eccentric motor which may be connected to the mounting frame 242' so that when the actuating motor 241' is actuated, the mounting frame 242' may move in a corresponding direction with respect to the outer case 10. In the present scenario, the mounting frame 242' may move to cause vibrations. Thus, the actuating motor 241' may be connected to the mounting frame 242' so as to drive the mounting frame 242' to move in the manner thus described. The actuating mechanism 24' may further comprise a plurality of (but at least one) resilient elements 244' mounted between the actuating motor 241' and the mounting frame 242' for providing shock absorption for stabilizing the mounting frame 242' and the moisture absorption enhancers 23 when the hand drying apparatus is in the drying mode. Each of the resilient elements 244' may be configured as a compression spring or other vibration absorbing components.

In the second alternative mode of the first preferred embodiment, the moisture absorption enhancers 23 may be driven to move according to the vibration movement of the actuating motor 241' and impart vibrations to the portion of fabric and user's hands.

Figure 8:
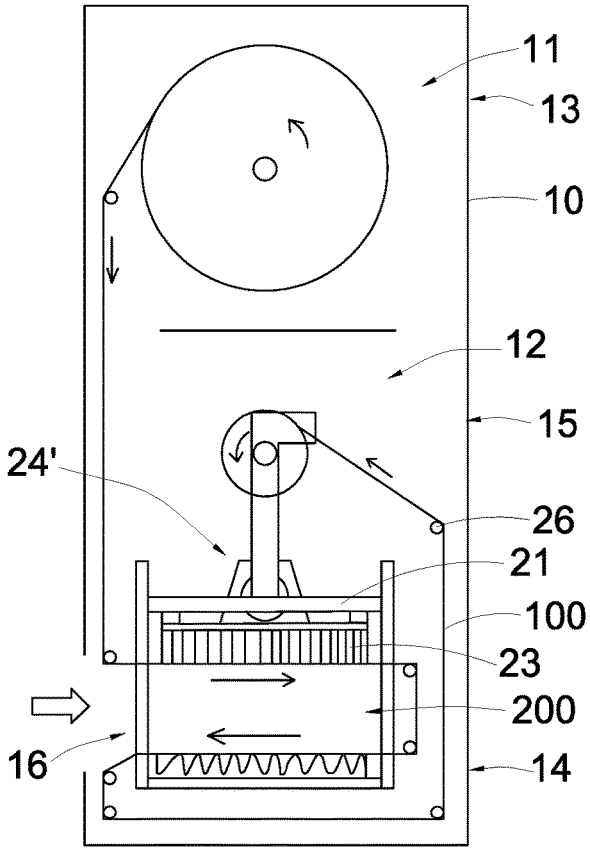
FIG. 8 is a side view of a hand drying apparatus according to a third alternative mode of the first preferred embodiment of the present invention.

FIG. 8 illustrates a third alternative mode of the hand drying apparatus according to the first preferred embodiment of the present invention. The third alternative mode is similar to the second alternative mode described above, except the general arrangement of the outer case 10. In this third alternative mode, the storage compartment 11 may be formed in the upper portion 13 of the outer case 10, while the collecting compartment 12 may be formed in the mid-portion 15 of the outer case 10. Thus, the moisture absorption arrangement 20 may be formed in the lower portion 14 of the outer case 10.

The moisture absorption arrangement 20 in the third alternative mode may be structurally identical to that of the second alternative mode described above, except that the drying cavity 200 and the access opening 16 may be formed in the lower portion 14 of the outer case 10. Thus, a user may be able to access the drying cavity 200 through the lower portion 14 of the outer case 10.

Figure 9:
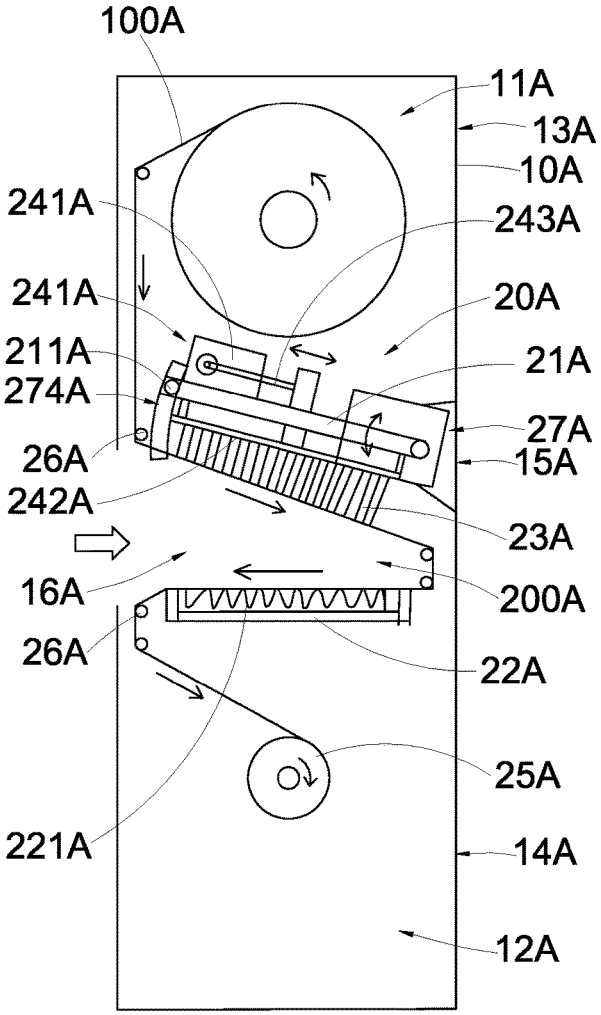
FIG. 9 is a side view of a hand drying apparatus according to a second preferred embodiment of the present invention.

Referring to FIG. 9 of the drawings, a hand drying apparatus according to a second preferred embodiment of the present invention is illustrated. As in the first preferred embodiment described above, the hand drying apparatus may comprise an outer case 10A and a moisture absorption arrangement 20A. The moisture absorption arrangement 20A may comprise a first supporting member 21A, a second supporting member 22A, a plurality of moisture absorption enhancers 23A, an actuating mechanism 24A, at least one driving rotor 25A, a plurality of fabric supporters 26A, and a driving mechanism 27A.

The first supporting member 21A and a second supporting member 22A may be provided in the outer case 10A. The second supporting member 22A may be provided in the outer case 10A at a position spaced apart from the first supporting member 21A to form at least one drying cavity 200A as a space formed between the first supporting member 21A and the second supporting member 22A for accommodating the user's hand.

The plurality of moisture absorption enhancers 23A may be supported on the first supporting member 21A and extend in the drying cavity 200A.

The driving mechanism 27A may be supported in the outer case 10A and connected to one of the first supporting member 21A and the second supporting member 22A for driving at least the first supporting member 21A to pivotally move with respect to the second supporting member 22A.

The actuating mechanism 24A may be supported in the outer case 10A to operatively drive the moisture absorption enhancers 23A.

The driving rotor 25A may be rotatably supported in the outer case 10A for driving the fabric sheet 100A to move in a predetermined direction in the outer case 10A.

The plurality of fabric supporters 26A may be provided in the outer case 10A and positioned to support the fabric sheet 100A between the first supporting member 21A and the second supporting member 22A in a slidably movable manner.

The hand drying apparatus may be operated between an idle mode and a drying mode, wherein in the idle mode, the first supporting member 21A and the second supporting member 22A may be positioned and retained to space apart from each other, wherein in the drying mode, the first supporting member 21A is driven to pivotally move toward the second supporting member 22A by the driving mechanism 27A for allowing the fabric sheet 100A supported on the first supporting member 21A and the second supporting member 22A to contact with the user's hand in the drying cavity 200A. The actuating mechanism 24A may then drive the moisture absorption enhancers 23A to move for absorbing moisture from the user's hand.

The outer case 10A may be structurally identical to what was described in the first preferred embodiment above. Thus, the outer case 10A may have a storage compartment 11A and a collecting compartment 12A. The fabric sheet 100A may be guided to controllably move from the storage compartment 11A to the collecting compartment 12A through the moisture absorption arrangement 20A. In this second preferred embodiment, the storage compartment 11A may be provided on an upper portion 13A of the outer case 10A, while the collecting compartment 12A may be provided on a lower portion 14A of the outer case 10A. The moisture absorption arrangement 20A may be provided between the storage compartment 11A and the collecting compartment 12A at a mid-portion 15A of the outer case 10A.

As in the first preferred embodiment of the present invention, the fabric sheet 100A may be configured as a roll and may be supported in the storage compartment 11A, possibly through a latch or a roller. A certain amount of the fabric sheet 100A may be pulled out from the roll and fed to the moisture absorption arrangement 20A to have a continuous supply of fabric sheet 100.

The outer case 10A may further have an access opening 16A provided on the outer case 10A for allowing a user to access the drying cavity 200A through the access opening 16A. Thus, the access opening 16A may be formed at a position corresponding to that of the drying cavity 200A. Again, the number of drying cavities 200A and the access openings 16A may be varied according to an actual configuration of the present invention.

The driving rotor 25A may be distributed in the outer case 10 in a rotatably movable manner for driving the fabric sheet 100A to move from the storage compartment 11A and pass through the drying cavity 200A and to be finally collected in the collecting compartment 12A. The fabric sheet 100A may be supported on the driving rotor 25A and the fabric supporters 26A in a stretched manner so as to maintain a predetermined tension on the fabric sheet 100A.

Specifically, at least two of the fabric supporter 26A may be provided in outer case 10A in such a manner that a portion of unused fabric sheet 100A may extend above the first supporting member 21A and the second supporting member 22A. The exact number of driving rotors 25A and the fabric supporters 26A employed in the outer case 10A may depend on the exact configuration of the outer case 10A, and the desirable travel path of the fabric sheet 100A.

As in the first preferred embodiment, the fabric supporters 26A may be mounted in the outer case 10A for supporting the fabric sheet 100A in a tensioned manner. The fabric supporters 26A may be stationary or rotatably mounted in the outer case 10A. The purpose of the fabric supporters 26A is to guide and support the fabric sheet 100A to travel in a predetermined direction as driven by the driving rotor 25A. The exact number of the fabric supporters 26A may depend on the exact configuration of the outer case 10A, and the desirable travel path of the fabric sheet 100A. For example, as shown in FIG. 9 of the drawings, two fabric supporters 26A may be mounted near two ends of the first supporting member 21A respectively, while another two fabric supporters 26A may be mounted near two ends of the second supporting member 22A respectively, wherein the fabric sheet 100A may be guided to extend on the first supporting member 21A and the second supporting member 22A to form a substantially V-shaped configuration or contour of the fabric sheet 100A as viewed from the side.

Each of the fabric supporters 26A may be configured as an elongated rod or pin which may provide secure support to the fabric sheet 100A when it is driven to move by the driving rotor 25A. Other shapes may also be possible.

The first supporting member 21A and the second supporting member 22A may be mounted in the outer case 10A for providing supports to the fabric sheet 100A and the user's hand. At least one of the first supporting member 21A and the second supporting member 22A may be pivotally supported in the outer case 10A. The movement of the first supporting member 21A and/or the second supporting member 22A may be actuated by the driving mechanism 27A described below. In the second preferred embodiment of the present invention, the second supporting member 22A is securely and immovably supported in the outer case 10A while the first supporting member 21A may be pivotally supported in the outer case 10A to pivotally move toward or away from the second supporting member 22A about a shaft 210A. As shown in FIG. 9 of the drawings, the first supporting member 21A may be provided at a position above the second supporting member 22A.

The second supporting member 22A may be configured as a panel for allowing a user's hand to rest thereon. This panel may be flat or may have predetermined contour. The first supporting member 21A may be arranged to support the moisture absorption enhancers 23A in a movable manner. Thus, the first supporting member 21A may be configured as a panel or a supporting frame on which the moisture absorption enhancers 23A are mounted. The moisture absorption enhancers 23A may extend downwardly from the first supporting member 21A to reach the drying cavity 200A.

Figure 10:
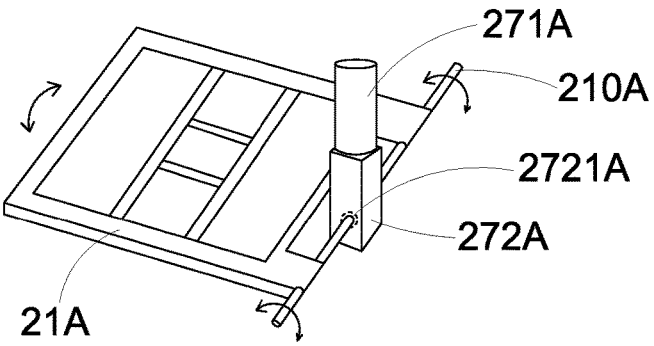
FIG. 10 is a schematic diagram of a driving mechanism of the hand drying apparatus according to a second preferred embodiment of the present invention.

Referring to FIG. 10 of the drawings, the driving mechanism 27A may comprise a driving motor 271A, and a transmission box 272A connected to the driving motor 271A. The transmission box 272A may comprise a transmission members 2721A coupled to the driving motor 271A and the shaft 210A of the first supporting member 21A respectively, so that when the driving motor 271A is driven to rotate, the transmission members 2721A in the transmission box 272A are also driven to rotate so as to drive the shaft 210A of the first supporting member 21A to rotate as well. When the shaft 210A of the first supporting member 21A is driven to rotate, the entire first supporting member 21A may also be driven to rotate so as to pivotally move toward or away from the second supporting member 22A about the shaft 210A. Thus, the driving motor 271A may be coupled to the first supporting member 21A through the transmission box 272A for exerting a driving torque thereto so as to drive the first supporting member 21A to pivotally move toward or away from the second supporting member 22A. Note that the driving mechanism 27A may be provided on a front portion or a rear portion of the first supporting member 21A. Each of the transmission members 2721A may be configured as transmission gears, transmission belt, transmission chains, or similar mechanical components.

The driving mechanism 27A may further comprise a guiding track 274A formed on the outer case 10A, wherein the first supporting member 21A may further comprise a guiding pin 211A extending to engage with the guiding track 274A. The guiding track 274A may have a curved cross-sectional shape to correspond to a pivotal movement of the first supporting member 21A about the shaft 210A. When the first supporting member 21A is driven to move pivotally toward or away from the second supporting member 22A, the guiding track 274A may be arranged to stabilize and guide the pivotal movement of the first supporting member 21A. Moreover, two ends of the guiding track 274A may serve as limits of the pivotal movement of the first supporting member 21A.

The moisture absorption arrangement 20A may further comprise at least one deformable pad 221A supported on the second supporting member 22A for supporting the user's hand. When the user's hand rest on the second supporting member 22A, the deformable pad 221A may slightly deform due to the hand's weight. Further deformation may occur when the first supporting member 21A and the moisture absorption enhancers 23A are driven to depress on the user's hand. The deformable pad 221A may be configured from soft or foam material such as memory foam. The deformable pad 221A may be supported on an upper side of the second supporting member 22A while a portion of the fabric sheet 100A may be supported on the deformable pad 221A.

As in the first preferred embodiment of the present invention, the moisture absorption arrangement 20A may further comprise at least one electric motor 251A connected to the driving rotor 25A for driving the fabric sheet 100A to move along a path dictated by the distribution of the driving rotor 25A.

The moisture absorption enhancers 23A may be configured as a plurality of brushes or a soft pad of a specific shape which may be made from soft and flexible material extending from the first supporting member 21A. In order to drive the moisture absorption enhancers 23A, the actuating mechanism 24A may comprise an actuating motor 241A mounted on the first supporting member 21A, and a mounting frame 242A movably mounted on the first supporting member 21A, wherein the moisture absorption enhancers 23A may be mounted on the mounting frame 242A.

As shown in FIG. 9 of the drawings, the mounting frame 242A may be connected to a driving shaft 243A of the actuating motor 241A. The actuating motor 241A may be configured as an eccentric or normal motor so that when the actuating motor 241A is actuated, the driving shaft 243A may also be driven to move in a reciprocating manner. When the driving shaft 243A is driven to move in the reciprocating manner with respect to the first supporting member 21A, the moisture absorption enhancers 23A may also be driven to move in corresponding directions so as to facilitate a back-and-forth movement. This arrangement is identical to what has been disclosed in the first preferred embodiment above.

Figure 12:
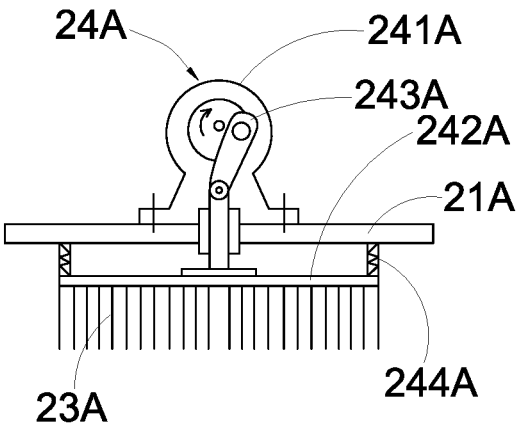
FIG. 12 is schematic view of an alternative configuration of an actuating motor of the hand drying apparatus according to the second preferred embodiment of the present invention.

As shown in FIG. 12 of the drawings, some other alternatives of the actuating motor 24A comprises an actuating motor 241A having a driving shaft 243A, and a connection member 244A connecting the first supporting member 21A to the mounting frame 242A, wherein the driving shaft 243A may be driven to move in a reciprocating manner along a vertical direction with respect to the mounting frame 242A. When the actuating motor 241A is driven to move, the mounting frame 242A and the moisture absorption enhancers 23A may also be driven to move in corresponding directions so as to facilitate corresponding reciprocating movement and facilitate up-and-down massage movement on the user's hand. The actuating motor 241A may be configured as an eccentric or normal motor. The connection member 244A may be configured as a guiding shaft or a compression spring.

Figure 11:
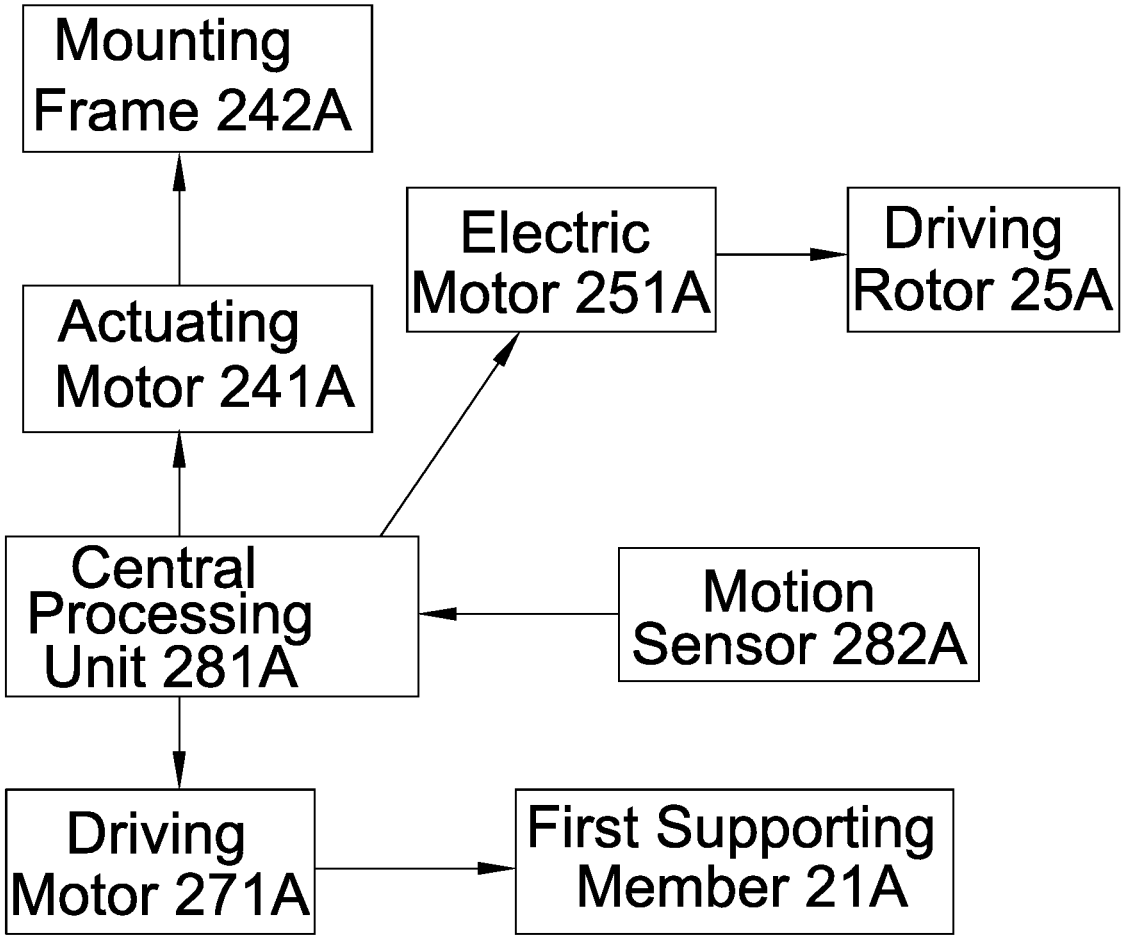
FIG. 11 is a block diagram illustrating the relationship between a driving rotor, an electric motor, an actuating motor, and a central processing unit of the hand drying apparatus according to the second preferred embodiment of the present invention.

As shown in FIG. 11 of the drawings, the moisture absorption arrangement 20A may further comprise a central processing unit 281A electrically connected to the electric motor 251A and the driving motor 271A, and at least one motion sensor 282A provided in the drying cavity 200A and electrically connected to the central processing unit 281A for sensing presence of motion in the drying cavity 200A. The central processing unit 281A may be programmed to control the operation of the driving motor 271A, the electric motor 251A and the actuating motor 241A when signals from the motion sensor 282A are received. When motion signal is received, the central processing unit 281A may drive the driving motor 271A to pivotally move the first supporting member 21A toward the second supporting member 22A as guided by the guiding track 274A, and at the same time, to drive the fabric sheet 100A to move in the direction from the storage compartment 11A to the collecting compartment 12A. Furthermore, the central processing unit 281 may also drive the actuating motor 241A to start the reciprocal movement when the first supporting member 21A has moved toward the second supporting member 22A.

The operation of the present invention in this second preferred embodiment may be described as follows: when no object is in the drying cavity 200A, the hand drying apparatus is idle. When a user wants to dry his hand, he may put his hands into the drying cavity 200A through the access opening 16A. When his hands are in the drying cavity 200A and rest his hands on the fabric sheet 100A disposed on the deformable pad 221A and the second supporting member 22A, the motion sensor 282A may detect motion and send the corresponding signal to the central processing unit 281A. The central processing unit 281A may then drive the corresponding driving motor 271A to rotate so as to actuate the driving mechanism 271A. The first supporting member 21A may then be driven to pivotally move toward the second supporting member 22A until a predetermined distance or angle of inclination between the first supporting member 21A and the second supporting member 22A is reached.

At this time, the central processing unit 281A may actuate the actuating motor 241A so as to drive the mounting frame 243A and the moisture absorption enhancers 23A to move on the user's hand in a reciprocating manner. As mentioned above, the reciprocating movement of the moisture absorption enhancers 23A may create a brushing or massage effect to the user's hand. As such, the user's hand may be dried by "dual actions", in which the first action being a pivotal squeezing action between the first supporting member 21A and the second supporting member 22A, while the second action being the brushing action effectuated by the moisture absorption enhancers 23A. This is somewhat identical to what has been described in the first preferred embodiment above.

The first supporting member 21A may be configured to depress on the user's hand for a predetermined period of time. When the first supporting member 21A reaches a predetermined distance from the second supporting member 22A, the actuating mechanism 24A may be actuated to perform the brushing action on the user's hand. After the actuating mechanism 24A has been actuated for a predetermined amount of time, the actuating mechanism 24A may be deactivated and the first supporting member 21A may be driven to move away from the second supporting member 22A. At this time, the user may move his hands out of the drying cavity 200A through the access opening 16A. The electric motor 251A may then be actuated to drive the fabric sheet 100A to move forward toward the direction of collecting compartment 12A so as to replace used fabric sheet 100A in the drying cavity 200A with unused fabric sheet 100A.

According to the second preferred embodiment of the present invention, the guiding track 274A may be provided in the vicinity of the access opening 16A, while the transmission box 272A may be provided in the outer case 10A at a position opposite to the access opening 16A so that when the pivotal movement of the first supporting member 21A is being performed, the access opening 16A may have a height gradually decreasing, as shown in FIG. 9 of the drawings.

Alternatively, the guiding track 274A may be provided in the rear portion of the outer case 10A at a position opposite to the access opening 16A, while the transmission box 272A may be provided in the vicinity of the access opening 16A.

As in the first preferred embodiment of the present invention, in this second preferred embodiment, the arrangement of the various components of the hand drying apparatus as described above may have several alternatives and variations. Some of these alternatives and variations may be described below.

Figure 13:
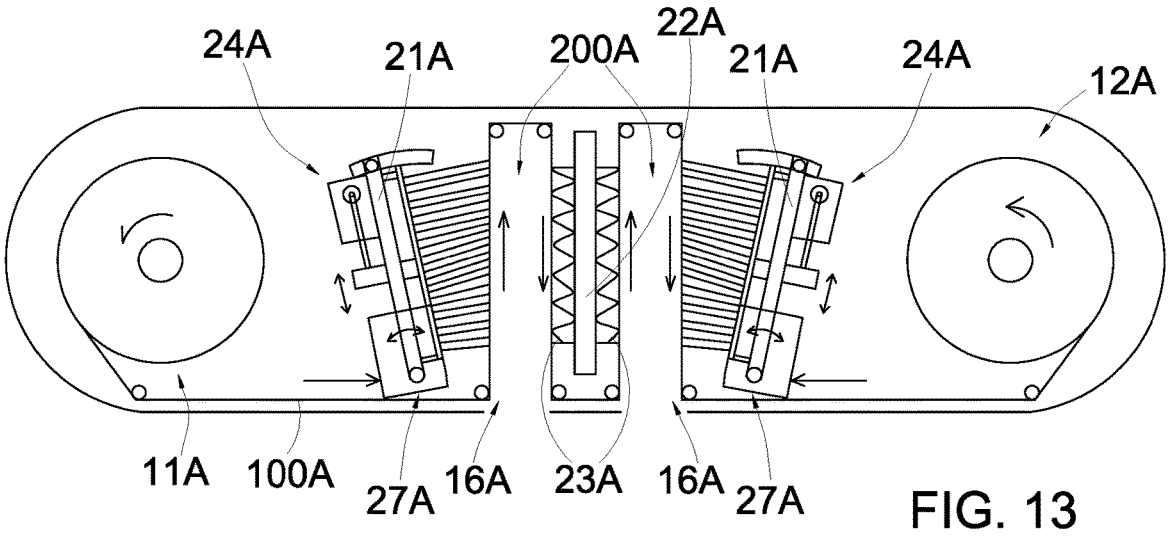
FIG. 13 is a plan view of the first alternative mode of the hand drying apparatus according to the second preferred embodiment of the present invention.

For example, as shown in FIG. 13 of the drawings, as a first alternative mode of the second preferred embodiment, the hand drying apparatus may comprise two drying cavities 200A and two access openings 16A arranged in a side-by-side manner so that fabric sheet 100A may travel from the storage compartment 11A sidewardly to the moisture absorption arrangement 20A and eventually to the collecting compartment 12A. The drying cavities 200A and the access openings 16A may be shaped and sized to form a vertical orientation. The orientation of the drying cavities 200A and the access openings 16A may determine the orientation in which the user's hands are disposed in the drying cavities 200A. The configuration of the other components may also be adjusted accordingly.

In this first alternative mode of the second preferred embodiment, some components of the moisture absorption arrangement 20A described above may be doubled so as that each of the drying cavities 200A may be serviced by one more first supporting member 21A, one more deformable pad 23A supported on two sides of the second supporting member 22A, one more actuating mechanism 24A and one more driving mechanism 27A described above.

Figure 14:
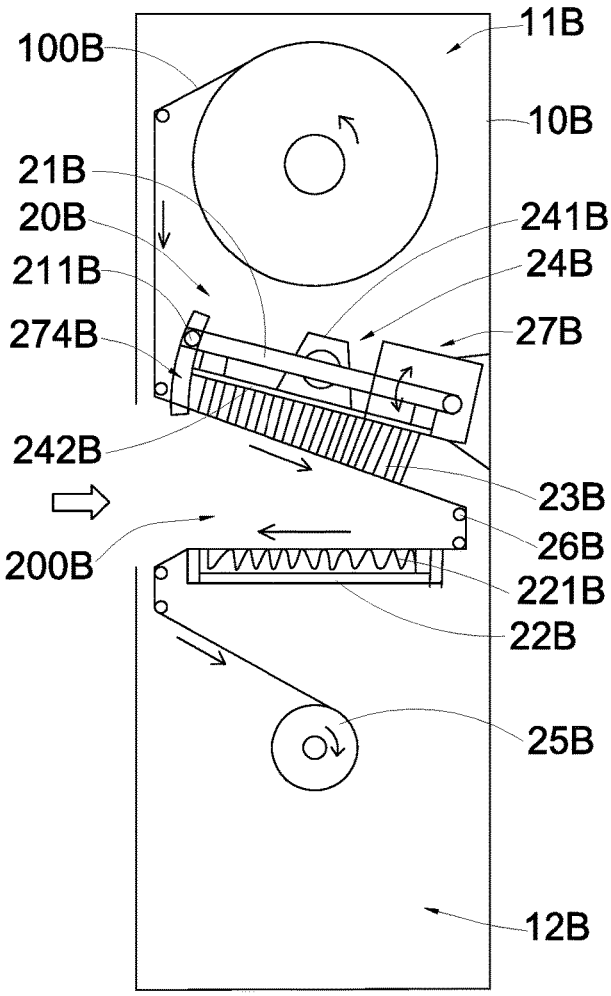
FIG. 14 is a side view of a second alternative mode of the hand drying apparatus according to the second preferred embodiment of the present invention.
Figure 15:
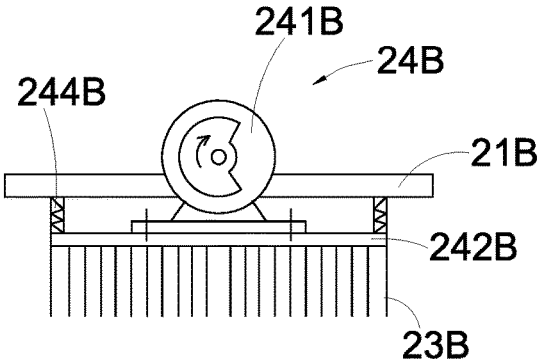
FIG. 15 is a schematic diagram of an actuating mechanism of the hand drying apparatus according to a second alternative mode of the second preferred embodiment of the present invention.

Referring to FIG. 14 and FIG. 15 of the drawings, a second alternative mode of the hand drying apparatus according to the second preferred embodiment of the present invention is illustrated. The second alternative mode is identical to the second preferred embodiment described above, except the actuating mechanism 24B. According to the second alternative mode, the actuating mechanism 24B may be arranged to impart a vibration-like effect (instead of brushing or massage effect as described above) to the user's hand so as to enhance moisture absorption from the user's hand through vibration movement of the moisture absorption enhancers 23B.

Specifically, the actuating mechanism 24B in the second alternative mode may comprise an actuating motor 241B connected to the mounting frame 242B of the first supporting member 21A, wherein the moisture absorption enhancers 23B may extend from the mounting frame 242B to reach the drying cavity 200B. The actuating motor 241B may be configured as an eccentric motor which may be connected to the mounting frame 242B so that when the actuating motor 241B is actuated, the mounting frame 242B may move in a corresponding direction with respect to the outer case 10B. In the present scenario, the mounting frame 242B may move as vibration. Thus, the actuating motor 242B may be connected to the mounting frame 242B so as to drive the mounting frame 242B to move in the manner thus described. The actuating mechanism 24B may further comprise a plurality of (but at least one) resilient elements 244B mounted between the actuating motor 241B and the mounting frame 242B for providing vibration absorption for stabilizing the mounting frame 242B and the moisture absorption enhancers 23B when the hand drying apparatus is in the drying mode. Each of the resilient elements 244B may be configured as a compression spring or other vibration absorbing component.

In the second alternative mode of the second preferred embodiment, the moisture absorption enhancers 23B may be driven to move according to the movement of the actuating motor 241B and impart vibrations to the user's hand.

In this second alternative mode of the second preferred embodiment, other components of the hand drying apparatus are identical to those disclosed in the second preferred embodiment above. Thus, the hand drying apparatus may also comprise an outer case 10B and a moisture absorption arrangement 20B. The moisture absorption arrangement 20B may comprise the first supporting member 21B, the second supporting member 22A, the moisture absorption enhancers 23B, at least one driving rotor 25B, a plurality of fabric supporters 26B, and a driving mechanism 27B. The first supporting member 21A and a second supporting member 22A may be provided in the outer case 10B to form the drying cavity 200B.

The actuating mechanism 24A may be supported in the outer case 10A to operatively drive the moisture absorption enhancers 23A.

The driving rotor 25A may be rotatably supported in the outer case 10A for driving the fabric sheet 100A to move in a predetermined direction in the outer case 10A.

The first supporting member 21B may be driven to pivotally move toward the second supporting member 22B by the driving mechanism 27B for allowing the fabric sheet 100B supported on the first supporting member 21A and the second supporting member 22B to contact with the user's hand in the drying cavity 200B. The actuating mechanism 24B may then drive the moisture absorption enhancers 23B to move for absorbing moisture from the user's hand.

The outer case 10B may have a storage compartment 11B and a collecting compartment 12B. The fabric sheet 100A may be guided to controllably move from the storage compartment 11B to the collecting compartment 12B through the moisture absorption arrangement 20B.

The driving mechanism 27B may also comprise a guiding track 274B formed on the outer case 10B, wherein the first supporting member 21A also comprises a guiding pin 211B extending to engage with the guiding track 274B. Moreover, the moisture absorption arrangement 20B may also comprise at least one deformable pad 221B supported on the second supporting member 22B for supporting the user's hand.

Figure 16:
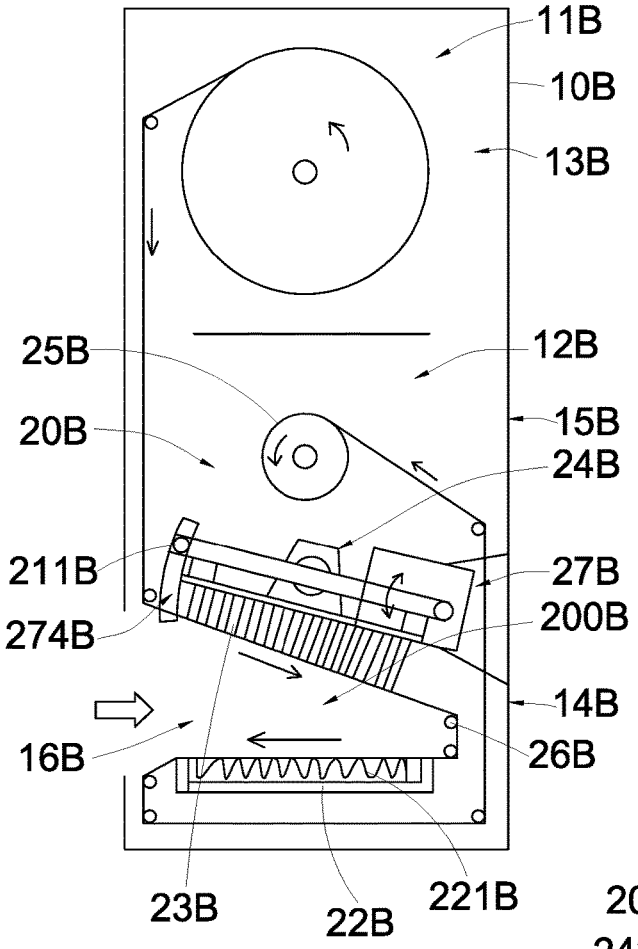
FIG. 16 is a side view of a hand drying apparatus according to a third alternative mode of the second preferred embodiment of the present invention.

FIG. 16 illustrates a third alternative mode of the hand drying apparatus according to the second preferred embodiment of the present invention. The third alternative mode is similar to the second alternative mode of the second preferred embodiment described above, except the general arrangement of the outer case 10B. In this third alternative mode, the storage compartment 11B may be formed in the upper portion 13B of the outer case 10B, while the collecting compartment 12B may be formed in the mid-portion 15B of the outer case 10B. Thus, the moisture absorption arrangement 20B may be formed in the lower portion 14B of the outer case 10B.

The moisture absorption arrangement 20B in the third alternative mode may be structurally identical to that of the second alternative mode, except that the drying cavity 200B and the access opening 16B may be formed in the lower portion 14B of the outer case 10B. Thus, a user may be able to access the drying cavity 200B through the lower portion 14B of the outer case 10B.

Figure 17:
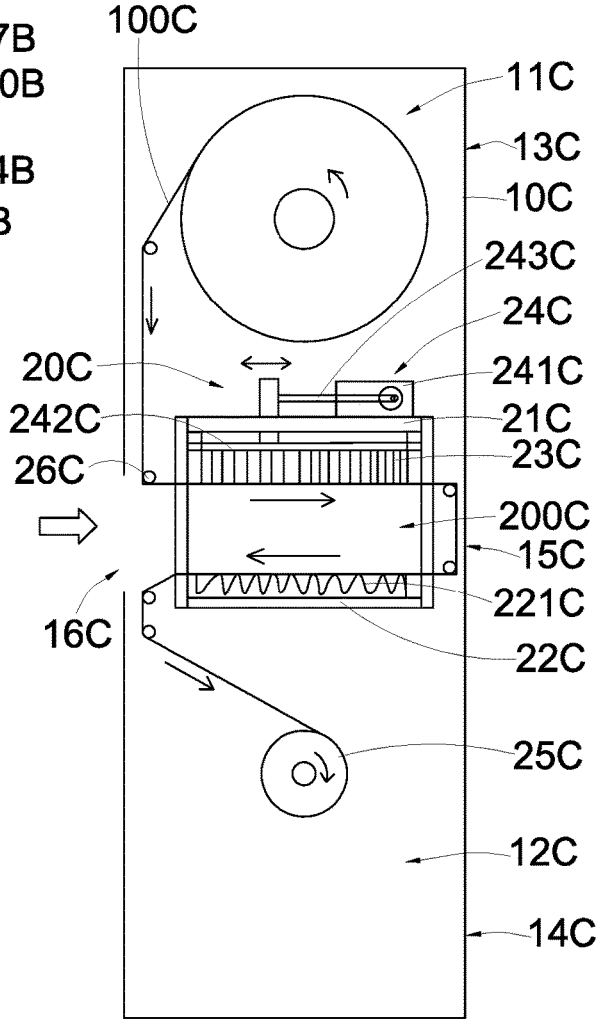
FIG. 17 is a side view of a hand drying apparatus according to a third preferred embodiment of the present invention.

Referring to FIG. 17 of the drawings, a hand drying apparatus according to a third preferred embodiment of the present invention is illustrated. The third preferred embodiment is structurally identical to the first preferred embodiment described above, except the absence of the driving mechanism 27 so that the first supporting member 21 and the second supporting member 22 may be secured in the outer case 10 without relative movement therebetween.

Thus, in this third preferred embodiment, the hand drying apparatus may comprise an outer case 10C and a moisture absorption arrangement 20C. The hand drying apparatus may be configured for a fabric sheet 100C used for absorbing moisture from a user's hand. The fabric sheet 100C may be a sheet of paper towel or a sheet of fabric towel.

The moisture absorption arrangement 20C may comprise a first supporting member 21C, a second supporting member 22C, a plurality of moisture absorption enhancers 23C, an actuating mechanism 24C, at least one driving rotor 25C, and a plurality of fabric supporters 26C.

The first supporting member 21C and a second supporting member 22C may be securely provided in the outer case 10C. The second supporting member 22C may be provided in the outer case 10C at a position spaced apart from the first supporting member 21C to form at least one drying cavity 200C as a space formed between the first supporting member 21C and the second supporting member 22C for accommodating the user's hand.

The plurality of moisture absorption enhancers 23C may be supported on the first supporting member 21C and extend in the drying cavity 200C.

The actuating mechanism 24C may be connected to the first supporting member 21C to operatively drive the moisture absorption enhancers 23C.

The driving rotor 25C may be rotatably supported in the outer case 10C for driving the fabric sheet 100C to move in a predetermined direction in the outer case 10C.

The plurality of fabric supporters 26C may be provided in the outer case 10C and positioned to support the fabric sheet 100C between the first supporting member 21C and the second supporting member 22C in a slidably movable manner.

The hand drying apparatus may be operated between an idle mode and a drying mode, wherein in the idle mode, the first supporting member 21C and the second supporting member 22C may be positioned and retained to space apart from each other, wherein in the drying mode, a user's hand may be accommodated in the drying cavity 200C while the actuating mechanism 24C may be arranged to drive the moisture absorption enhancers 23C to move along the users' hand so as to absorb moisture therefrom.

The structure of the outer case 10C in this third preferred embodiment may be identical to that of the first preferred embodiment described above. The outer case 10C may have a storage compartment 11C, and a collecting compartment 12C for storing used fabric sheet 100C. The fabric sheet 100C may be guided to controllably move from the storage compartment 11C to the collecting compartment 12C through the moisture absorption arrangement 20C. In this third preferred embodiment, the storage compartment 11C may be provided on an upper portion 13C of the outer case 10C, while the collecting compartment 12C may be provided on a lower portion 14C of the outer case 10C. The moisture absorption arrangement 20C may be provided between the storage compartment 11C and the collecting compartment 12C at a mid-portion 15C of the outer case 10C.

The outer case 10C may further have an access opening 16C provided on the outer case 10C for allowing a user to access the drying cavity 200C through the access opening 16C. The access opening 16C may be formed at a position corresponding to that of the drying cavity 200C so that a user may be able to put his or her hand in the drying cavity 200C through penetrating the access opening 16C.

The driving rotor 25C may be distributed in the outer case 10C in a rotatably movable manner for driving the fabric sheet 100C to move in a predetermined path dictated by the spatial distribution of the driving rotor 25C and the fabric supporters 26C. The driving rotor 25C may be arranged to support a portion of the fabric sheet 100C so that when the driving rotor 25C rotates, the fabric sheet 100C may be driven to move in the direction of rotation of the driving rotor 25C. In some variations, several driving rotors 25C may be provided to drive the fabric sheet 100C.

At least two of the fabric supporters 26C may be provided in outer case 10C in such a manner that a portion of unused fabric sheet 100C may extend above the first supporting member 21C and the second supporting member 22C. The exact number of the driving rotor 25C and the fabric supporters 26C employed in the outer case 10C may depend on the exact configuration of the outer case 10C, and the desirable travel path of the fabric sheet 100C, and is not limiting.

The fabric supporters 26C may be mounted in the outer case 10C for supporting the fabric sheet 100C in a tensioned manner. The fabric supporters 26C may be stationary or rotatably mounted in the outer case 10C. The purpose of the fabric supporters 26C is to guide and support the fabric sheet 100C to travel in a predetermined direction as driven by the driving rotor 25C. The exact number of the fabric supporters 26C may depend on the exact configuration of the outer case 10C. For example, as shown in FIG. 17 of the drawings, two fabric supporters 26C may be mounted near two ends of the first supporting member 21C respectively, while other two fabric supporters 26C may be mounted near two ends of the second supporting member 22C respectively, wherein the fabric sheet 100C may be guided to extend on the first supporting member 21C and the second supporting member 22C so as to form a U-shaped configuration or contour of the fabric sheet 100C as viewed from the side.

Each of the fabric supporters 26C may be configured as an elongated rod or pin which may provide secure support to the fabric sheet 100C when it is driven to move by the driving rotor 25C. Other shapes may also be possible.

The first supporting member 21C and the second supporting member 22C may be mounted in the outer case 10C for providing supports to the fabric sheet 100C and the user's hand. In this third preferred embodiment of the present invention, both the first supporting member 21C and the second supporting member 22C may be fixed (i.e. immovable) in the outer case 10C and may be parallel with each other. However, the first supporting member 21C and the second supporting member 22C may have a predetermined angle of inclination so that the first supporting member 21C and the second supporting member 22C may resemble the configuration shown in the second preferred embodiment, except that both the first supporting member 21C and the second supporting member 22C are stationary. Each of the first supporting member 21C and the second supporting member 22C may be mounted or connected in the outer case 10C as a separate element. Alternatively, the first supporting member 21C and the second supporting member 22C may also be integrally formed on the outer case 10C.

In the third preferred embodiment of the present invention, the outer case 10C may be configured as having an elongated structure. The first supporting member 21C may be provided above the second supporting member 22C.

The second supporting member 22C may be configured as a panel for allowing a user's hand to rest thereon. This panel may be flat or may have predetermined contour. The first supporting member 21C may be arranged to support the moisture absorption enhancers 23C in a movable manner. Thus, the first supporting member 21C may be configured as a panel or a supporting frame on which a mounting frame 242C or board are movably mounted. Also, the moisture absorption enhancers 23C is mounted on the downside of mounting frame 242C. The moisture absorption enhancers 23C may extend downwardly from the first supporting member 21C to reach the drying cavity 200C.

Depending on the circumstances in which the present invention is manufactured or operated, the position the first supporting member 21C and the second supporting member 22C may be interchanged.

The moisture absorption arrangement 20C may further comprise at least one deformable pad 221C supported on the second supporting member 22C for supporting the user's hand. When the user's hand rest on the second supporting member 22C, the deformable pad 221C may slightly deform due to the hand's weight. The deformable pad 221C may be configured as soft or foam material such as memory foam, silicone pad, sponge foam, etc. The deformable pad 221C may be supported on an upper side of the second supporting member 22C while a portion of the fabric sheet 100C may be supported on the deformable pad 221C.

Figure 18:
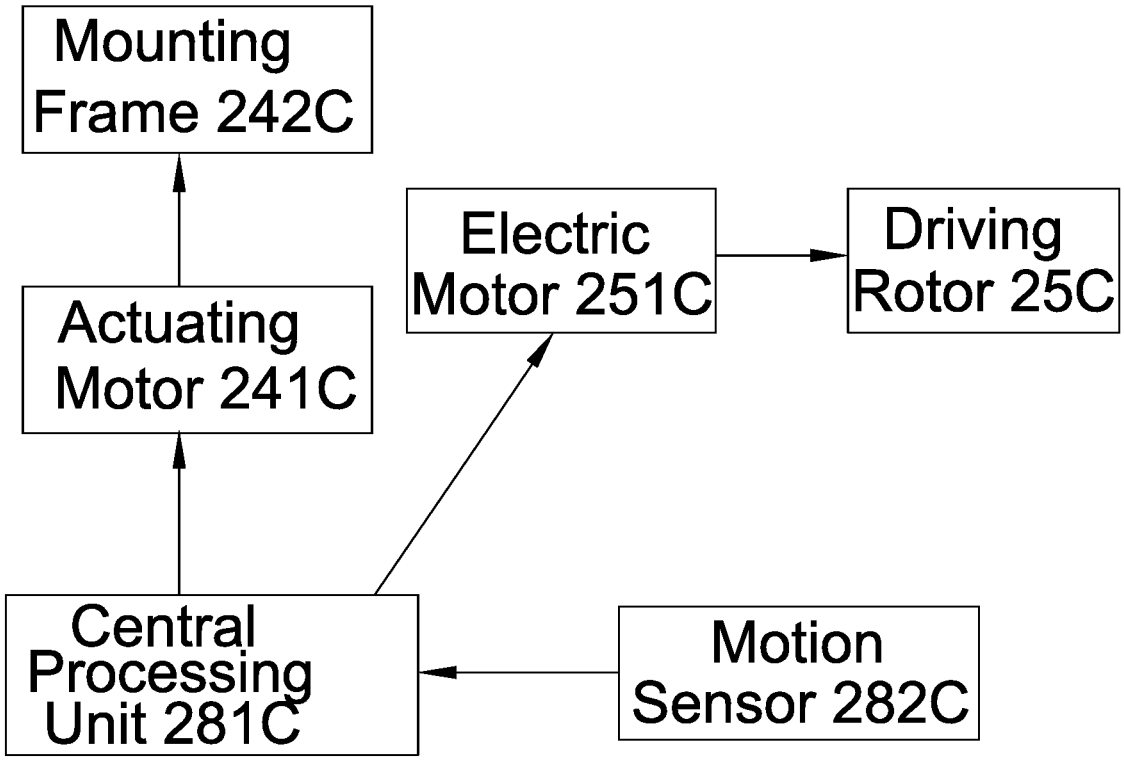
FIG. 18 is a block diagram illustrating the relationship between, an electric motor, an actuating motor, and a central processing unit of the hand drying apparatus according to the second preferred embodiment of the present invention.

As shown in FIG. 18 of the drawings, the moisture absorption arrangement 20C may further comprise at least one electric motor 251C connected to the driving rotor 25C for driving the fabric sheet 100C to move along a path dictated by the distribution of the driving rotor 25C. When the fabric sheet 100C is engaged with the driving rotor 25C, the rotational movement of the driving rotor 25C may drive a particular portion of the fabric sheet 100C to move along the corresponding fabric supporters 26C.

The moisture absorption enhancers 23C may be configured as a plurality of brushes or a soft pad of a specific shape which may be made from soft and flexible material extending from the first supporting member 21C. In order to drive the moisture absorption enhancers 23C, the actuating mechanism 24C may comprise an actuating motor 241C mounted on the first supporting member 21C, and a mounting frame 242C movably mounted on the first supporting member 21C, wherein the moisture absorption enhancers 23C may be mounted on the mounting frame 242C.

As shown in FIG. 17 of the drawings, the mounting frame 242C may be connected to a driving shaft 243C of the actuating motor 241C. The actuating motor 241C may be configured as an eccentric or normal motor so that when the actuating motor 241C is actuated, the driving shaft 243C may also be driven to move in a reciprocating manner along a transverse direction of the mounting frame 242C. When the driving shaft 243C is driven to move in the reciprocating manner with respect to the first supporting member 21C, the mounting frame 242C and the moisture absorption enhancers 23C may also be driven to move in corresponding directions so as to facilitate a back-and-forth brushing movement on the user's hand. This arrangement is identical to what has been disclosed in the first preferred embodiment above.

As shown in FIG. 18 of the drawings, the moisture absorption arrangement 20C may further comprise a central processing unit 281C electrically connected to the electric motor 251C and the driving motor 271C, and at least one motion sensor 282C provided in the drying cavity 200C and electrically connected to the central processing unit 281C for sensing presence of motion in the drying cavity 200C. The central processing unit 281C may be programmed to control the operation of the electric motor 251C and the actuating motor 241C when signals from the motion sensor 282C are received. When motion signal is received, the central processing unit 281C may drive the actuating motor 241C to start the reciprocal movement on the user's hand.

Figure 19:
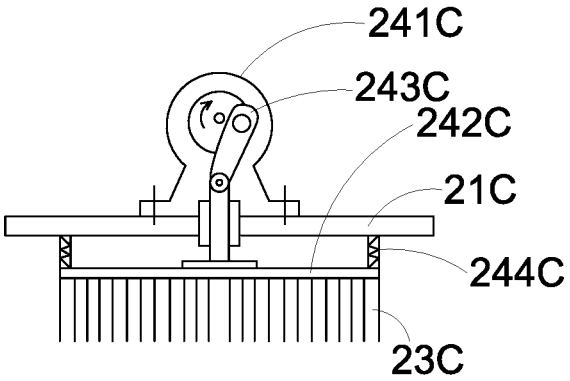
FIG. 19 is a schematic view of an alternative configuration of an actuating motor of the hand drying apparatus according to the third preferred embodiment of the present invention.

As shown in FIG. 19 of the drawings, some other alternatives of the actuating motor 24C comprises an actuating motor 241C having a driving shaft 243C, and a connection member 244C connecting the first supporting member 21C to the mounting frame 242C, wherein the driving shaft 243C may be driven to move in a reciprocating manner along a vertical direction with respect to the mounting frame 242C. When the actuating motor 241C is driven to move, the mounting frame 242C and the moisture absorption enhancers 23C may also be driven to move in corresponding directions so as to facilitate corresponding reciprocating movement to facilitate up-and-down massage movement on the user's hand. The actuating motor 241C may be configured as an eccentric or normal motor. The connection member 244C may be configured as a guiding shaft or a compression spring.

The operation of the present invention may be as follows: when no object is in the drying cavity 200C, the hand drying apparatus is idle. When a user wants to dry his hand, he may put his hands into the drying cavity 200C through the access opening 16C. When his hands are in the drying cavity 200C and rest his hands on the fabric sheet 100C disposed on the deformable pad 221C and the second supporting member 22C, the motion sensor 282C may detect motion and send the corresponding signal to the central processing unit 281C. The central processing unit 281C may then drive the actuating motor 241C so as to drive the mounting frame 242C and the moisture absorption enhancers 23C to move on the user's hand in a reciprocating manner. As mentioned above, the reciprocating movement of the moisture absorption enhancers 23C may create a brushing or massage effect to the user's hand to dry the user's hand.

After the actuating mechanism 24C has been actuated for a predetermined amount of time, the actuating mechanism 24C may be deactivated and the user may move his hands out of the drying cavity 200C through the access opening 16C. The electric motor 251C may then be actuated to drive the fabric sheet 100C to move forward toward the direction of collecting compartment 12C so as to replace used fabric sheet 100C in the drying cavity 200C with unused fabric sheet 100C.

In this third preferred embodiment, the first supporting member 21C and the second supporting member 22C may be supported in such a manner that they may be substantially parallel to each other. As a slight variation, the first supporting member 21C and the second supporting member 22C may form a predetermined angle of inclination with respect to each other so that the drying cavity 200C may having a gradually increasing or decreasing height from the access opening 16C.

It is worth mentioning that the arrangement of the various components of the hand drying apparatus as described in the first preferred embodiment above may also be applicable to the third preferred embodiment here. Some of these alternatives and variations may also be applicable. The storage compartment 11, the collecting compartment 12 and the moisture absorption arrangement 20 may be arranged and configured in a side-by-side manner (as opposed to up-and-down manner) so that fabric sheet 100 may travel from the storage compartment 11 sidewardly to the moisture absorption arrangement 20 and eventually to the collecting compartment 12. This configuration may resemble the configuration as shown in FIG. 5 of the drawings described above. Another configuration may be that of FIG. 8, in which the collecting compartment 12 may be formed at a mid portion 15 of the outer case 10, while the drying cavity 200 and the access opening 16 may be formed on the lower portion 14 of the outer case 10.

Figure 20:
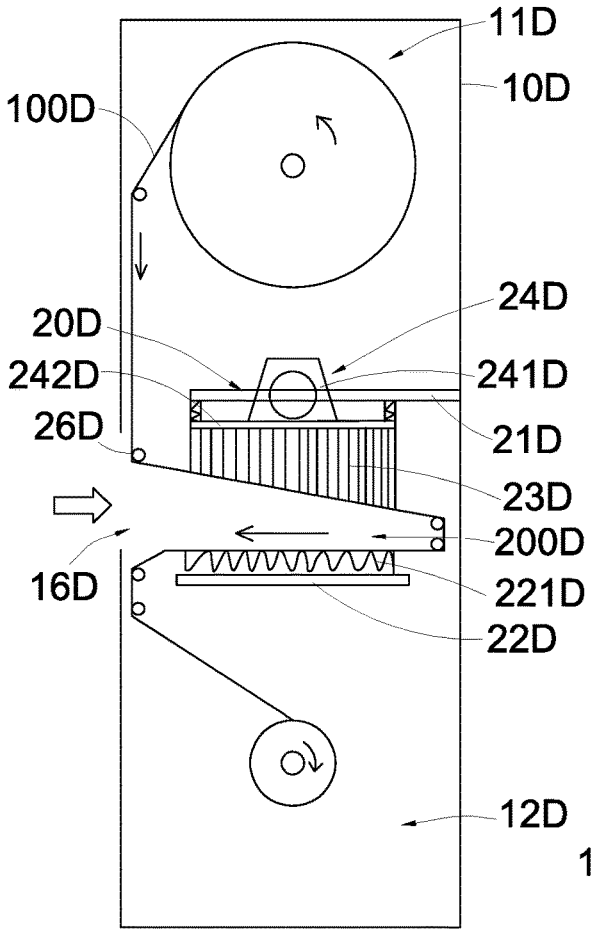
FIG. 20 is a side view of a second alternative mode of the hand drying apparatus according to the third preferred embodiment of the present invention.
Figure 21:
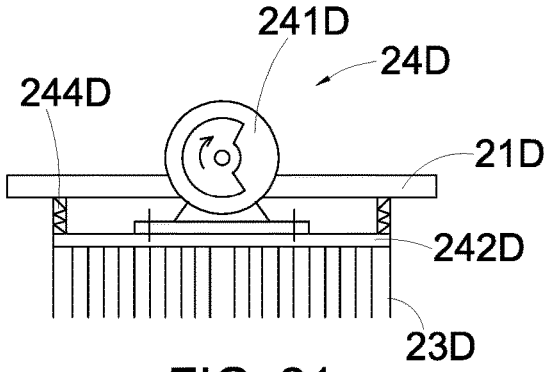
FIG. 21 is a schematic diagram of an actuating mechanism of the hand drying apparatus according to a second alternative mode of the third preferred embodiment of the present invention.

Referring to FIG. 20 and FIG. 21 of the drawings, a first alternative mode of the hand drying apparatus according to the third preferred embodiment of the present invention is illustrated. The first alternative mode is identical to the third preferred embodiment described above, except the actuating mechanism 24D. According to the second alternative mode of the third preferred embodiment, the actuating mechanism 24D may be arranged to impart a vibration-like effect (instead of brushing or massage effect mentioned above) to the user's hand so as to enhance moisture absorption from the user's hand through vibration movement of the moisture absorption enhancers 23D.

Specifically, the actuating mechanism 24D in the second alternative mode of the third preferred embodiment may comprise an actuating motor 241D connected to the mounting frame 242D of the first supporting member 21D, wherein the moisture absorption enhancers 23D may extend from the mounting frame 242D to reach the drying cavity. The actuating motor 241D may be configured as an eccentric motor which may be connected to the mounting frame 242D so that when the actuating motor 241D is actuated, the mounting frame 242D may move in a corresponding direction with respect to the outer case 10D. In the present scenario, the mounting frame 242D may move as vibration. Thus, the actuating motor 242D may be connected to the mounting frame 242D so as to drive the mounting frame 242D to move in the manner thus described. The actuating mechanism 24D may further comprise a plurality of (but at least one) resilient elements 244D mounted between the actuating motor 241D and the mounting frame 242D for providing shock absorption for stabilizing the mounting frame 242D and the moisture absorption enhancers 23D when the hand drying apparatus is in the drying mode. Each of the resilient elements 244D may be configured as a compression spring or other vibration absorbing components.

Figure 22:
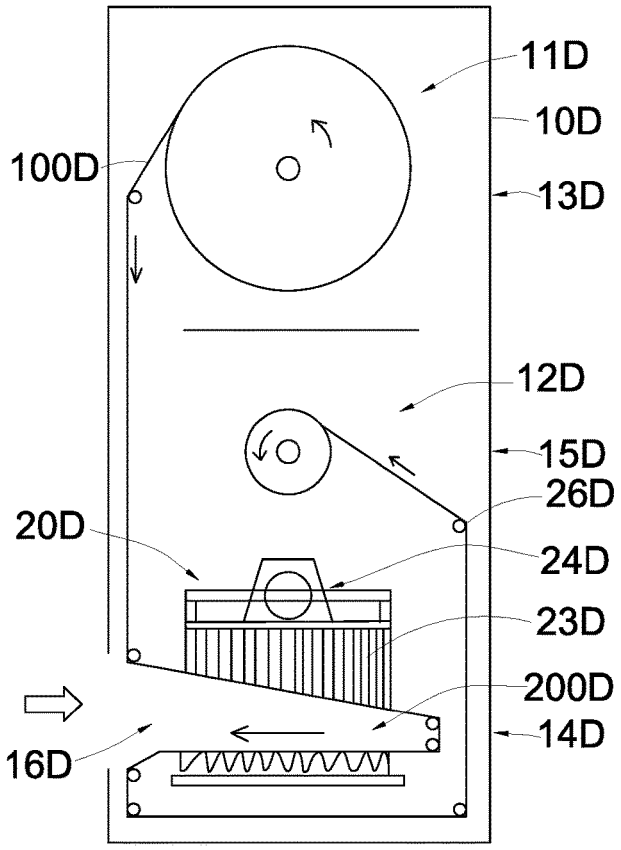
FIG. 22 is a side view of a hand drying apparatus according to a third alternative mode of the third preferred embodiment of the present invention.

FIG. 22 illustrates a second alternative mode of the hand drying apparatus according to the third preferred embodiment of the present invention. The second alternative mode is similar to the first alternative mode of the third preferred embodiment described above, except the general arrangement of the outer case 10D. In this second alternative mode, the storage compartment 11D may be formed in the upper portion 13D of the outer case 10D, while the collecting compartment 12D may be formed in the mid-portion 15D of the outer case 10D. Thus, the moisture absorption arrangement 20D, which includes the actuating mechanism 24D and the moisture absorption enhancers 23D may be formed in the lower portion 14D of the outer case 10D for driving the fabric sheet 100D as supported by the fabric supporters 26D.

The moisture absorption arrangement 20D in the second alternative mode of the third preferred embodiment may be structurally identical to that of the first alternative mode of the third preferred embodiment, except that the drying cavity 200D and the access opening 16D may be formed in the lower portion 14D of the outer case 10D. Thus, a user may be able to access the drying cavity 200D through the lower portion 14D of the outer case 10D.

The present invention, while illustrated and described in terms of a preferred embodiment and several alternatives, is not limited to the particular description contained in this specification. Additional alternative or equivalent components could also be used to practice the present invention.

What is claimed is:

1. A hand drying apparatus for a fabric sheet used for absorbing moisture from a user's hand, said hand drying apparatus comprising:

an outer case; and a moisture absorption arrangement, which comprises:

a first supporting member and a second supporting member provided in said outer case, said second supporting member being provided in said outer case at a position spaced apart from said first supporting member to form at least one drying cavity as a space formed between said first supporting member and said second supporting member for accommodating said user's hand;

a plurality of moisture absorption enhancers supported on said first supporting member and extend in said drying cavity;

a driving mechanism supported in said outer case and connected to one of said first supporting member and said second supporting member for driving at least said first supporting member to move with respect to said second supporting member;

an actuating mechanism supported in said outer case which is driven by a motor to operatively drive said moisture absorption enhancers;

at least one driving rotor rotatably supported in said outer case for driving said fabric sheet to move in a predetermined direction;

a plurality of fabric supporters provided in said outer case and positioned to support said fabric sheet between said first supporting member and said second supporting member in a slidably movable manner;

said hand drying apparatus being operated between an idle mode and a drying mode, wherein in said idle mode, said first supporting member and said second supporting member are positioned and retained to space apart from each other, wherein in said drying mode, said first supporting member is driven to move toward said second supporting member by said driving mechanism for allowing said fabric sheet supported on said first supporting member and said second supporting member to contact with said user's hand in said drying cavity and absorb moisture from said user's hands, then said actuating mechanism driving said moisture absorption enhancers move for absorbing moisture from said user's hands and finger crevices to obtain a greater drying effect.

2. The hand drying apparatus, as recited in claim 1, wherein said moisture absorption arrangement further comprises a driving mechanism provided in said outer case for driving said first supporting member to move toward or away from said second supporting member, said driving mechanism comprising a driving motor mounted in said outer case and connect to said first supporting member, wherein when said driving motor is actuated, said driving motor is arranged to drive said first supporting member to move toward or away from said second supporting member.

3. The hand drying apparatus, as recited in claim 2, wherein said driving mechanism further comprises a plurality of guiding rods extended between said first supporting member and said second supporting member for guiding a movement of said first supporting member.

4. The hand drying apparatus, as recited in claim 1, wherein said second supporting member is securely supported in said outer case while said first supporting member is pivotally supported in said outer case to pivotally move toward or away from said second supporting member.

5. The hand drying apparatus, as recited in claim 4, wherein said first supporting member further have a shaft and said driving mechanism comprises a driving motor, wherein when said driving motor is driven to rotate, said shaft of said first supporting member is also driven to rotate and drive said first supporting member to pivotally move toward or away from said second supporting member about said shaft.

6. The hand drying apparatus, as recited in claim 5, wherein said driving mechanism further comprises a guiding track formed on said outer case, wherein said first supporting member further comprising a guiding pin extending to engage with said guiding track, said guiding track having a curved cross-sectional shape to correspond to a pivotal movement of said first supporting member about said shaft.

7. The hand drying apparatus, as recited in claim 1, wherein said moisture absorption enhancers are configured as a plurality of brushes which are made from soft and flexible material extending toward said drying cavity.

8. The hand drying apparatus, as recited in claim 3, wherein said moisture absorption enhancers are configured as a plurality of brushes which are made from soft and flexible material extending toward said drying cavity.

9. The hand drying apparatus, as recited in claim 6, wherein said moisture absorption enhancers are configured as a plurality of brushes which are made from soft and flexible material extending toward said drying cavity.

10. The hand drying apparatus, as recited in claim 3, wherein said actuating mechanism comprises an actuating motor having a driving shaft mounted in said outer case, and a mounting frame movably mounted on said first supporting member, wherein said moisture absorption enhancers are mounted on said mounting frame, said mounting frame being connected to said driving shaft of said actuating motor, wherein when said actuating motor is actuated, said driving shaft is driven to move in a reciprocating manner so as to drive said moisture absorption enhancers to move in corresponding directions for facilitating a reciprocating movement on the fabric which is covered on said user's hand, said reciprocating movement being one of back-and-forth and up-and-down reciprocating movement.

11. The hand drying apparatus, as recited in claim 6, wherein said actuating mechanism comprises an actuating motor having a driving shaft mounted in said outer case, and a mounting frame movably mounted on said first supporting member, wherein said moisture absorption enhancers are mounted on said mounting frame, said mounting frame being connected to said driving shaft of said actuating motor, wherein when said actuating motor is actuated, said driving shaft is driven to move in a reciprocating manner so as to drive said moisture absorption enhancers to move in corresponding directions for facilitating a reciprocating movement on the fabric which is covered on said user's hand, said reciprocating movement being one of back-and-forth or up-and-down reciprocating movement.

12. The hand drying apparatus, as recited in claim 8, wherein said actuating mechanism comprises an actuating motor having a driving shaft mounted in said outer case, and a mounting frame movably mounted on said first supporting member, wherein said moisture absorption enhancers are mounted on said mounting frame, said mounting frame being connected to said driving shaft of said actuating motor, wherein when said actuating motor is actuated, said driving shaft is driven to move in a reciprocating manner so as to drive said moisture absorption enhancers to move in corresponding directions for facilitating a reciprocating movement on the fabric which is covered on said user's hand, said reciprocating movement being back-and-forth or up-and-down reciprocating movement.

13. The hand drying apparatus, as recited in claim 9, wherein said actuating mechanism comprises an actuating motor having a driving shaft mounted in said outer case, and a mounting frame movably mounted on said first supporting member, wherein said moisture absorption enhancers are mounted on said mounting frame, said mounting frame being connected to said driving shaft of said actuating motor, wherein when said actuating motor is actuated, said driving shaft is driven to move in a reciprocating manner so as to drive said moisture absorption enhancers to move in corresponding directions for facilitating a reciprocating movement on the fabric which is covered on said user's hand, said reciprocating movement being one of back-and-forth or up-and-down reciprocating movement.

14. The hand drying apparatus, as recited in claim 3, wherein said actuating mechanism comprises an actuating motor mounted in said outer case, and a mounting frame movably mounted on said first supporting member, said moisture absorption enhancers extending from said mounting frame to reach said drying cavity, said actuating motor being configured as an eccentric motor and connected to said mounting frame so that when said actuating motor is actuated, said mounting frame and said moisture absorption enhancers are arranged to move in a corresponding direction with respect to said outer case so as to impart a vibration-like effect to said user's hand.

15. The hand drying apparatus, as recited in claim 6, wherein said actuating mechanism comprises an actuating motor mounted in said outer case, and a mounting frame movably mounted on said first supporting member, said moisture absorption enhancers extending from said mounting frame to reach said drying cavity, said actuating motor being configured as an eccentric motor and connected to said mounting frame so that when said actuating motor is actuated, said mounting frame and said moisture absorption enhancers are arranged to move in a corresponding direction with respect to said outer case so as to impart a vibration-like effect to said user's hand.

16. The hand drying apparatus, as recited in claim 8, wherein said actuating mechanism comprises an actuating motor mounted in said outer case, and a mounting frame movably mounted on said first supporting member, said moisture absorption enhancers extending from said mounting frame to reach said drying cavity, said actuating motor being configured as an eccentric motor and connected to said mounting frame so that when said actuating motor is actuated, said mounting frame and said moisture absorption enhancers are arranged to move in a corresponding direction with respect to said outer case so as to impart a vibration-like effect to said user's hand.

17. The hand drying apparatus, as recited in claim 9, wherein said actuating mechanism comprises an actuating motor mounted in said outer case, and a mounting frame movably mounted on said first supporting member, said moisture absorption enhancers extending from said mounting frame to reach said drying cavity, said actuating motor being configured as an eccentric motor and connected to said mounting frame so that when said actuating motor is actuated, said mounting frame and said moisture absorption enhancers are arranged to move in a corresponding direction with respect to said outer case so as to impart a vibration-like effect to said user's hand.

18. A hand drying apparatus for a fabric sheet used for absorbing moisture from a user's hand, said hand drying apparatus comprising:

an outer case; and a moisture absorption arrangement, which comprises:

a first supporting member and a second supporting member provided in said outer case, said second supporting member being provided in said outer case at a position spaced apart from said first supporting member to form at least one drying cavity as a space formed between said first supporting member and said second supporting member for accommodating said user's hand;

a plurality of moisture absorption enhancers supported on said first supporting member and extend in said drying cavity;

an actuating mechanism connected to said first supporting member to operatively drive said moisture absorption enhancers;

at least one driving rotor rotatably supported in said outer case for driving said fabric sheet to move in a predetermined direction;

a plurality of fabric supporters provided in said outer case and positioned to support said fabric sheet between said first supporting member and said second supporting member in a slidably movable manner;

said hand drying apparatus being operated between an idle mode and a drying mode, wherein in said idle mode, said first supporting member and said second supporting member are positioned and retained to space apart from each other, wherein in said drying mode, said actuating mechanism is arranged to drive said moisture absorption enhancers to move for absorbing moisture from said user's hands and finger crevices.

19. The hand drying apparatus, as recited in claim 18, wherein said moisture absorption enhancers are configured as a plurality of brushes which are made from soft and flexible material extending from said first supporting member toward said drying cavity.

20. The hand drying apparatus, as recited in claim 18, wherein said actuating mechanism comprises an actuating motor having a driving shaft mounted in said outer case, and a mounting frame movably mounted on said first supporting member, wherein said moisture absorption enhancers are mounted on said mounting frame, said mounting frame being connected to said driving shaft of said actuating motor, wherein when said actuating motor is actuated, said driving shaft is driven to move in a reciprocating manner so as to drive said moisture absorption enhancers to move in corresponding directions, said reciprocating movement being one of back-and-forth or up-and-down reciprocating movement.

21. The hand drying apparatus, as recited in claim 19, wherein said actuating mechanism comprises an actuating motor having a driving shaft mounted in said outer case, and a mounting frame movably mounted on said first supporting member, wherein said moisture absorption enhancers are mounted on said mounting frame, said mounting frame being connected to said driving shaft of said actuating motor, wherein when said actuating motor is actuated, said driving shaft is driven to move in a reciprocating manner so as to drive said moisture absorption enhancers to move in corresponding directions, said reciprocating movement being one of back-and-forth or up-and-down reciprocating movement.

22. The hand drying apparatus, as recited in claim 18, wherein said actuating mechanism comprises an actuating motor mounted in said outer case, and a mounting frame movably mounted on said first supporting member, said moisture absorption enhancers extending from said mounting frame to reach said drying cavity, said actuating motor being configured as an eccentric motor and connected to said mounting frame so that when said actuating motor is actuated, said mounting frame and said moisture absorption enhancers are arranged to move in a corresponding direction with respect to said outer case so as to impart a vibration-like effect to said user's hand.

23. The hand drying apparatus, as recited in claim 19, wherein said actuating mechanism comprises an actuating motor mounted in said outer case, and a mounting frame movably mounted on said first supporting member, said moisture absorption enhancers extending from said mounting frame to reach said drying cavity, said actuating motor being configured as an eccentric motor and connected to said mounting frame so that when said actuating motor is actuated, said mounting frame and said moisture absorption enhancers are arranged to move in a corresponding direction with respect to said outer case so as to impart a vibration-like effect to said user's hand.

* * * * *